US008346133B2

(12) United States Patent
Okabe et al.

(10) Patent No.: US 8,346,133 B2
(45) **Date of Patent: *Jan. 1, 2013**

(54) IMAGE-FORMING DEVICE HAVING MECHANISM FOR SEPARATING DEVELOPING ROLLERS FROM PHOTOSENSITIVE DRUMS

(75) Inventors: Yasushi Okabe, Nagoya (JP); Yoshito Takakuwa, Aisai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/159,650

(22) Filed: Jun. 14, 2011

(65) Prior Publication Data

US 2011/0243606 A1 Oct. 6, 2011

Related U.S. Application Data

(63) Continuation of application No. 12/846,081, filed on Jul. 29, 2010, now Pat. No. 7,986,906, which is a continuation of application No. 11/525,944, filed on Sep. 25, 2006, now Pat. No. 7,792,464.

(30) Foreign Application Priority Data

Sep. 30, 2005 (JP) ..... 2005-288201

(51) Int. Cl.
*G03G 15/01* (2006.01)

(52) U.S. Cl. ..... 399/228

(58) Field of Classification Search ..... 399/110–112, 399/119, 126, 223, 228
See application file for complete search history.

(56) References Cited

U.S. PATENT DOCUMENTS

| | | | |
|---|---|---|---|
| 4,939,547 | A | 7/1990 | Miyaji et al. |
| 5,099,292 | A | 3/1992 | Hirose |
| 6,470,166 | B2 | 10/2002 | Mizoguchi et al. |
| 6,681,088 | B2 | 1/2004 | Kanno et al. |
| 6,708,011 | B2 | 3/2004 | Nomura et al. |
| 6,738,590 | B2 | 5/2004 | Okimura et al. |
| 6,795,671 | B2 | 9/2004 | Matsuoka |
| 6,978,103 | B2 | 12/2005 | Mura et al. |
| 2002/0018673 | A1 | 2/2002 | Mizoguchi et al. |
| 2002/0110386 | A1 | 8/2002 | Kanno et al. |
| 2003/0053819 | A1 | 3/2003 | Nomura et al. |
| 2005/0069347 | A1 | 3/2005 | Okabe |
| 2005/0147432 | A1 | 7/2005 | Mura et al. |

FOREIGN PATENT DOCUMENTS

CN 1369750 A 9/2002

(Continued)

OTHER PUBLICATIONS

CN Office Action dtd Oct. 31, 2008, CN Appln. 2006101421709, English translation.

(Continued)

*Primary Examiner* — Walter L Lindsay, Jr.
*Assistant Examiner* — Milton Gonzalez
(74) *Attorney, Agent, or Firm* — Banner & Witcoff, Ltd.

(57) ABSTRACT

A laser printer includes a contact/separation mechanism that linearly moves developing cartridges between contact positions where the developing cartridges contact corresponding photosensitive drums and separating positions where the developing cartridges separate from the photosensitive drums. The contact/separation mechanism includes a pair of contact/separation members and a synchronous moving mechanism. The contact/separation members are disposed one on one side of the developing cartridges and another on another side of the developing cartridges. The synchronous moving mechanism is for linearly moving the contact/separation members in synchronization with each other.

15 Claims, 30 Drawing Sheets

FOREIGN PATENT DOCUMENTS

| | | | |
|---|---|---|---|
| JP | 2-116870 | A | 5/1990 |
| JP | 4-213557 | A | 8/1992 |
| JP | 4-341873 | A | 11/1992 |
| JP | 8-220819 | A | 8/1996 |
| JP | 8-220829 | A | 8/1996 |
| JP | 2000-298421 | A | 10/2000 |
| JP | 2001-318508 | A | 11/2001 |
| JP | 2002-006716 | A | 1/2002 |
| JP | 2003-015378 | A | 1/2003 |
| JP | 2003-050531 | A | 2/2003 |
| JP | 2003-167499 | A | 6/2003 |
| JP | 2003-287992 | A | 10/2003 |
| JP | 2003-316233 | A | 11/2003 |
| JP | 2004-013030 | A | 1/2004 |
| JP | 2004-020855 | A | 1/2004 |
| JP | 2004-163795 | A | 6/2004 |
| JP | 2004-301899 | A | 10/2004 |
| JP | 2005-107189 | A | 4/2005 |

OTHER PUBLICATIONS

JP Office Action dtd Apr. 13, 2010, JP Appln. 2005-288201, English translation.

IMAGE-FORMING DEVICE HAVING MECHANISM FOR SEPARATING DEVELOPING ROLLERS FROM PHOTOSENSITIVE DRUMS

CROSS REFERENCE TO RELATED APPLICATIONS

This application is a continuation of prior U.S. application Ser. No. 12/846,081, filed Jul. 29, 2010, which is a continuation of prior U.S. application Ser. No. 11/525,944, filed Sep. 25, 2006, now U.S. Pat. No. 7,792,464 B2, issued Sep. 7, 2010, which claims priority from Japanese Patent Application No. 2005-288201, filed Sep. 30, 2005. The entire content of the priority application is incorporated herein by reference.

TECHNICAL FIELD

The disclosure relates to an image-forming device, such as a laser printer.

BACKGROUND

There has been known a tandem-type image-forming device including photosensitive drums for respective colors yellow, magenta, cyan, and black, wherein the photosensitive drums are arranged in a line. This type of image-forming device includes developing rollers for supplying toner of respective colors to the surfaces of the respective photosensitive drums. Supplying toner onto the surfaces of the photosensitive drums form toner images of respective colors substantially simultaneously.

The toner images on the surfaces of the respective photosensitive drums are directly transferred onto a sheet of paper with the images superimposed one on the other, forming a full-color image. Alternatively, the toner images are once transferred onto an intermediate transfer belt, forming a full-color image thereon, and the full-color image is transferred from the intermediate transfer belt onto a sheet of paper. In this manner, a full-color image is formed on a sheet of paper.

In one type of such a tandem-type image-forming device, each of the developing rollers is disposed to be capable of contacting and separating from the corresponding photosensitive drum.

For example, in an image-forming device proposed in Japanese Unexamined Patent-Application Publication No. 2002-6716, a lever is provided for each of developing units. By pressing the developing unit with the corresponding lever, a developing roller provided in the developing unit is separated from the corresponding photosensitive drum. By releasing the pressing, the developing roller is brought into contact with the corresponding photosensitive drum.

In an image-forming device proposed in Japanese Unexamined Patent-Application Publication No. 2004-301899, photosensitive drums and corresponding developing units are arranged in the vertical direction. A separating lever having a branch which gets under the corresponding developing unit is provided so as to be movable in the vertical direction. A developing roller provided in the developing unit is separated from the corresponding photosensitive drum by moving the separating lever upward to raise the corresponding developing unit with the branch and then rotating the developing unit about a rotational shaft thereof. On the other hand, the developing roller is brought into contact with the corresponding photosensitive drum by moving the separating lever downward to separate the branch from the developing unit and then rotating the developing unit about the rotational shaft (in a direction opposite to the direction to separate the developing roller from the photosensitive drum).

However, with the configuration disclosed in the Japanese Unexamined Patent-Application Publication No. 2002-6716, levers are required one for each developing unit, resulting in the increase in the number of components.

With the configuration disclosed in the Japanese Unexamined Patent-Application Publication No. 2004-301899, since the distance of separation between the photosensitive drum and the developing roller depends on the distance between the rotational shaft and the developing roller as well as the moving amount of the separating lever, variations in the distance of separation is likely to occur among the developing rollers. Especially when the branch of the separating lever is bent due to the weight of the developing unit, the distance of separation of the developing roller in the developing unit will greatly differ from that of the other developing rollers.

SUMMARY

In view of the foregoing, it is an object of the invention to provide an image-forming device including a conveying belt that conveys a recording medium, a plurality of image carrying members provided for respective colors and aligned in a first direction, a plurality of developing units provided in one-to-one correspondence with the plurality of image carrying members, first and second contact/separation members linearly movable in the first direction, and a synchronous moving mechanism that linearly moves the first and second contact/separation members in synchronization with each other. The image carrying members are in opposition to the conveying belt. The developing units include respective developer carrying members that supply developer to the corresponding image carrying members. The first and second contact/separation members are being disposed one on either side of the plurality of developing units in a second direction perpendicular to the first direction. While linearly moving in the first direction, the first and second contact/separation members linearly move the developing units between contact positions where the developer carrying members contact the corresponding image carrying members and separating positions where the developer carrying members separate from the corresponding image carrying members.

BRIEF DESCRIPTION OF THE DRAWINGS

Illustrative aspects in accordance with the invention will be described in detail with reference to the following figures wherein:

FIG. 25(*b*) is a front view of the control member at a releasing position;

FIG. 30(*b*) is a right side view showing the yellow, magenta, and cyan developing cartridges at contact positions and a black developing cartridge at a separating position;

FIG. 30(*c*) is a right side view showing the developing cartridges at separating positions.

DETAILED DESCRIPTION

Figure 1:
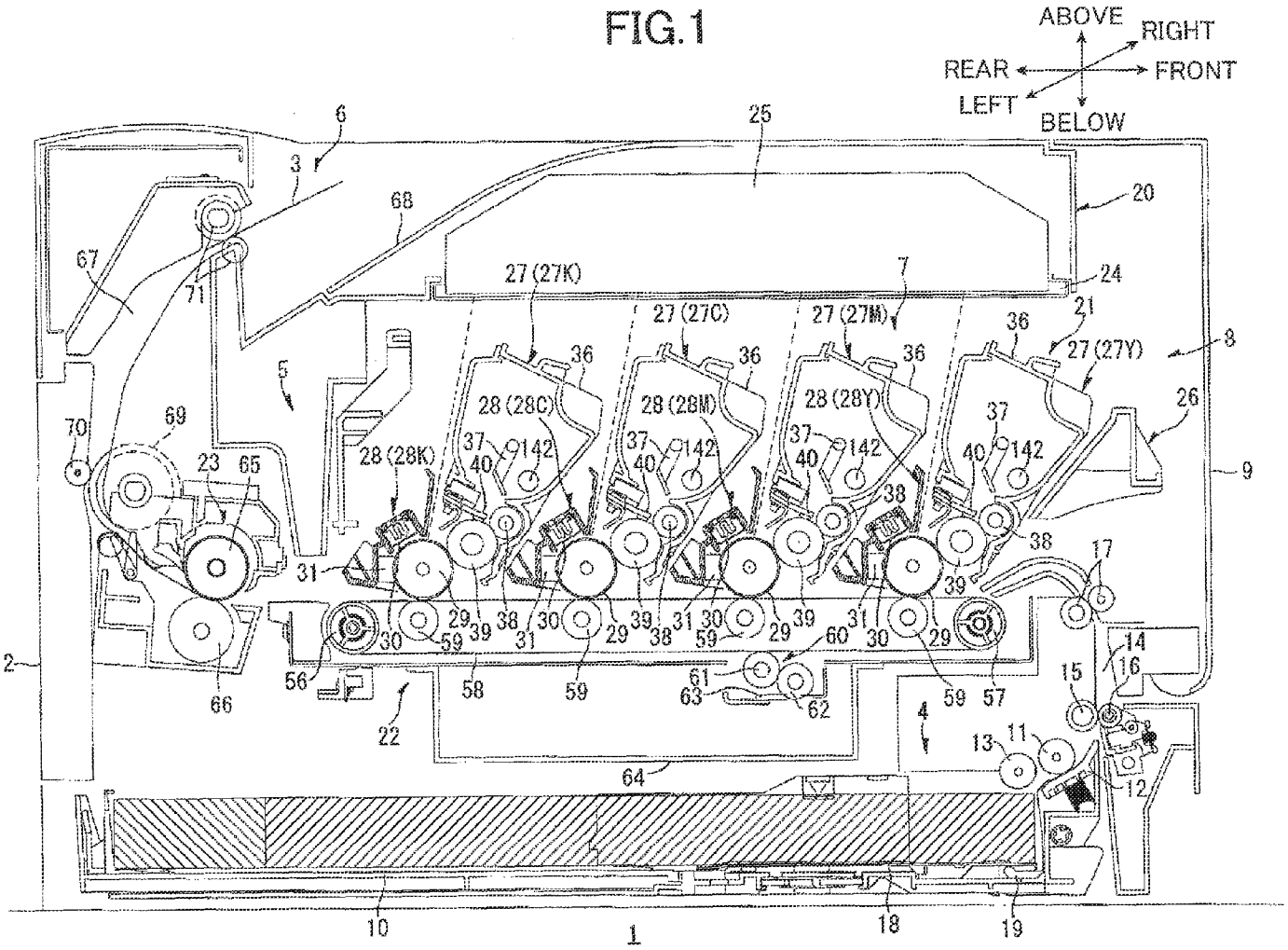
FIG. 1 is a cross-sectional side view of a laser printer according to illustrative aspects of the invention.

A laser printer 1 as an image-forming device according to some aspects of the invention will be described while referring to the accompanying drawings wherein like parts and components are designated by the same reference numerals to avoid duplicating description.

Note that in the following description, the expressions "front", "rear", "left", "right", "above", and "below" are used to define the various parts when the laser printer 1 is disposed in an orientation in which it is intended to be used.

As shown in FIG. 1, the laser printer 1 is a transversal tandem color laser printer including a plurality of drum subunits 28 described later arranged in the horizontal direction.

The laser printer 1 includes a main casing 2 and, within the main casing 2, a feeder unit 4 for feeding sheets of paper 3, an image-forming unit 5 for forming images on the fed paper 3, and a discharge unit 6 for discharging the paper 3 formed with the images.

The main casing 2 is shaped like a substantially rectangular box in a side view. A drum accommodating area 7 is formed inside the main casing 2 for accommodating a drum unit 26.

A front wall of the main casing 2 is formed with an access opening 8 in fluid communication with the drum accommodating area 7, and is provided with a front cover 9 capable of opening and closing over the access opening 8. The front cover 9 is supported by a pair of left and right cover supporting members 398 shown in FIG. 26 so as to be movable between an opened state shown in FIG. 26 where the front cover 9 inclines forward to open the access opening 8 and a closed state shown in FIG. 27 where the front cover 9 stands along the front surface of the main casing 2 to close the access opening 8.

When the front cover 9 is open, the access opening 8 is exposed, enabling the drum unit 26 to be mounted into or removed from the main casing 2 via the access opening 8.

The feeder unit 4 is provided in the bottom section of the main casing 2. The feeder unit 4 includes a paper tray 10, a separating roller 11, a separating pad 12, and a feeding roller 13. The paper tray 10 is for accommodating sheets of paper 3. The separating roller 11 and the separating pad 12 are disposed in opposition with each other above a front end of the paper tray 10. The feeding roller 13 is disposed to the rear of the separating roller 11. A supply-side conveying path 14 along which the paper 3 passes is defined in the feeder unit 4.

The supply-side conveying path 14 has a substantial U-shape in a plan view. An upstream end of the supply-side conveying path 14 with respect to a paper conveying direction is adjacent to the separating roller 11, and a downstream end thereof is adjacent to and located to the front of a conveying belt 58 described later. Disposed along the supply-side conveying path 14 are a paper-dust removing roller 15, a pinch roller 16 disposed in opposition to the paper-dust removing roller 15, and a pair of registration rollers 17 disposed above the paper-dust removing roller 15 and the pinch roller 16.

A paper-pressing plate 18 is provided inside the paper tray 10 for supporting the sheets of paper 3 in a stacked state. The paper-pressing plate 18 is pivotably supported on the rear end thereof, so that the paper-pressing plate 18 can pivot downward to a resting position in which the paper-pressing plate 18 rests on a bottom plate of the paper tray 10 and can pivot upward to a feeding position in which the paper-pressing plate 18 slopes upward from the rear end to the front end.

A lever 19 is provided below the front end of the paper tray 10 for lifting the front end of the paper-pressing plate 18 upward. The lever 19 is pivotably supported at a position below the front end of the paper-pressing plate 18 so as to pivot upward and downward.

When the lever 19 pivots upward to lift the front end of the paper-pressing plate 18, the paper-pressing plate 18 is brought into the feeding position.

When the paper-pressing plate 18 is in the feeding position, the topmost sheet of paper 3 stacked on the paper-pressing plate 18 is pressed against the feeding roller 13. The rotating feeding roller 13 begins feeding the sheets of paper 3 toward a position between the separating roller 11 and the separating pad 12.

When the paper tray 10 is removed from the main casing 2, the paper-pressing plate 18 settles into the resting position. While the paper-pressing plate 18 is in the resting position, the paper 3 can be stacked on the paper-pressing plate 18.

The sheets of paper 3 fed by the feeding roller 13 become interposed between the separating roller 11 and the separating pad 12 by the rotation of the separating roller 11, and the rotating separating roller 11 separates and feeds the paper 3 one sheet at a time. Each sheet of paper 3 fed by the separating roller 11 passes between the paper-dust removing roller 15 and the pinch roller 16. After the paper-dust removing roller 15 removes paper dust from the sheet of paper 3, the sheet is conveyed along the supply-side conveying path 14 toward the registration rollers 17. After registering the paper 3, the registration rollers 17 convey the paper 3 to the conveying belt 58.

The image-forming unit 5 includes a scanner unit 20, a process unit 21, a transfer unit 22, and a fixing unit 23.

The scanner unit 20 is disposed in an upper section of the main casing 2 and includes a base plate 24 extending in the right-to-left and front-to-rear directions and a scanner 25 fixed on the upper surface of the base plate 24. Although not shown in the drawings, disposed inside the scanner 25 are four sets of a light source, a polygon mirror, an f lens, a reflecting mirror, an optical face tangle error correction lens, and other optical components. Each light source emits a laser beam based on image data. The laser beam is deflected and scanned by the corresponding polygon mirror, passes through the corresponding f lens and the corresponding optical face tangle error correction lens, and is reflected by the corresponding reflecting mirror to be irradiated, in a high speed scanning operation, on the surface of a corresponding photosensitive drum 29 to be described later.

The process unit 21 is disposed below the scanner unit 20 and above the feeder unit 4. The process unit 21 includes the drum unit 26 and four developing cartridges 27 for respective colors.

The drum unit 26 is a tandem-type process unit and includes the four drum sub-units 28 for respective colors. The drum sub-units 28 include a yellow drum sub-unit 28Y, a magenta drum sub-unit 28M, a cyan drum sub-unit 28C, and a black drum sub-unit 28K.

The drum sub-units 28 are aligned and spaced at intervals in the front-to-rear direction. More specifically, the yellow drum sub-unit 28Y, the magenta drum sub-unit 28M, the cyan drum sub-unit 18C, and the black drum sub-unit 28K are aligned in order from the front to the rear.

Figure 3:
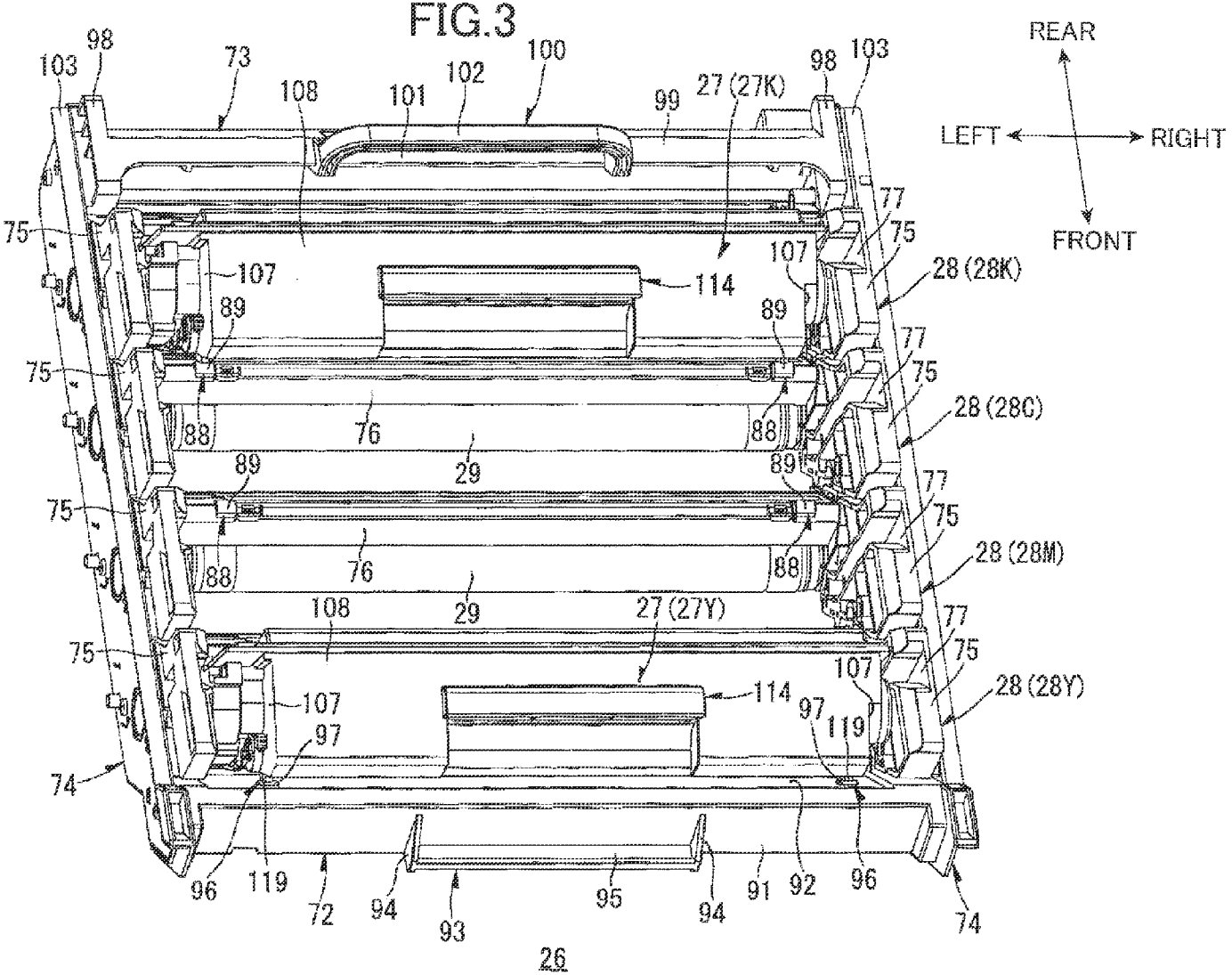
FIG. 3 is a perspective view of a drum unit of the laser printer in FIG. 1 with two developing cartridges attached thereto, as viewed from diagonally above.

As shown in FIG. 3, each drum sub-unit 28 includes a pair of side frames 75, 75 and a center frame 76 extending between and connected to the side frames 75, 75. Note that the side frames 75, 75 are not shown in FIG. 1 in order to simplify the drawing.

Figure 2:
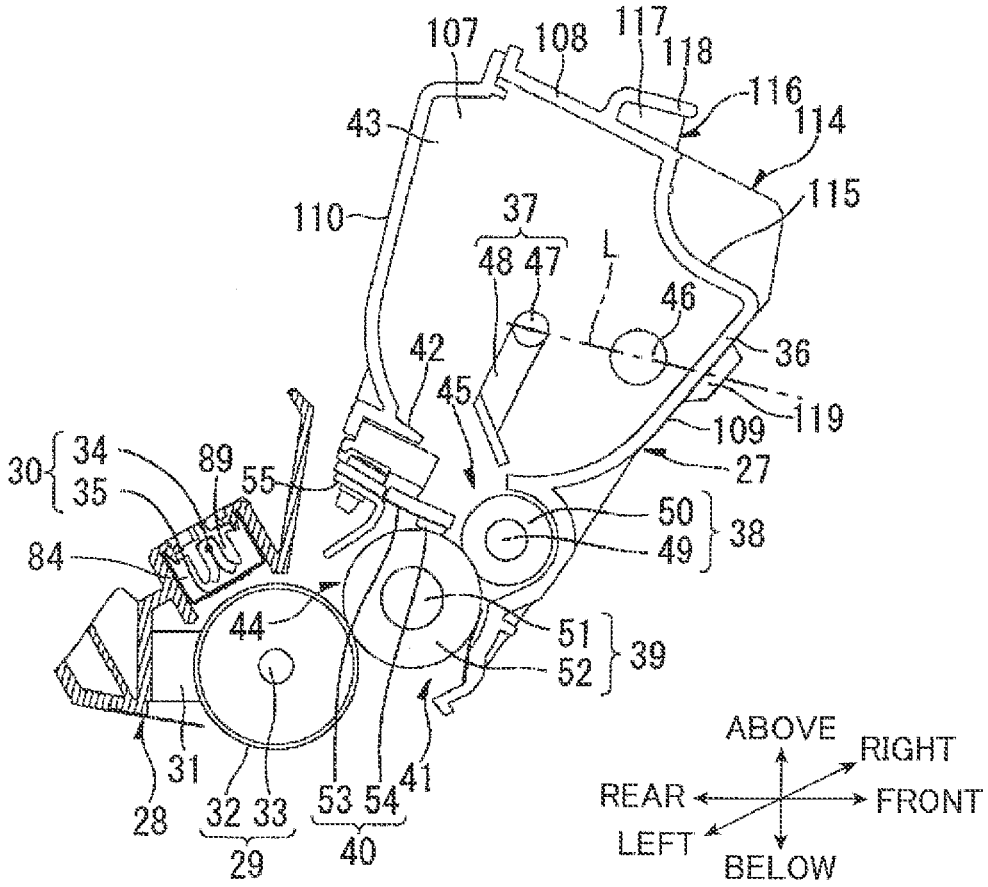
FIG. 2 is a cross-sectional side view of a representative developing cartridge and a representative drum sub-unit of the laser printer in FIG. 1.

FIG. 2 is a cross-sectional view showing representative one of the developing cartridges 27 and one of the drum sub-units 28.

Figure 7:
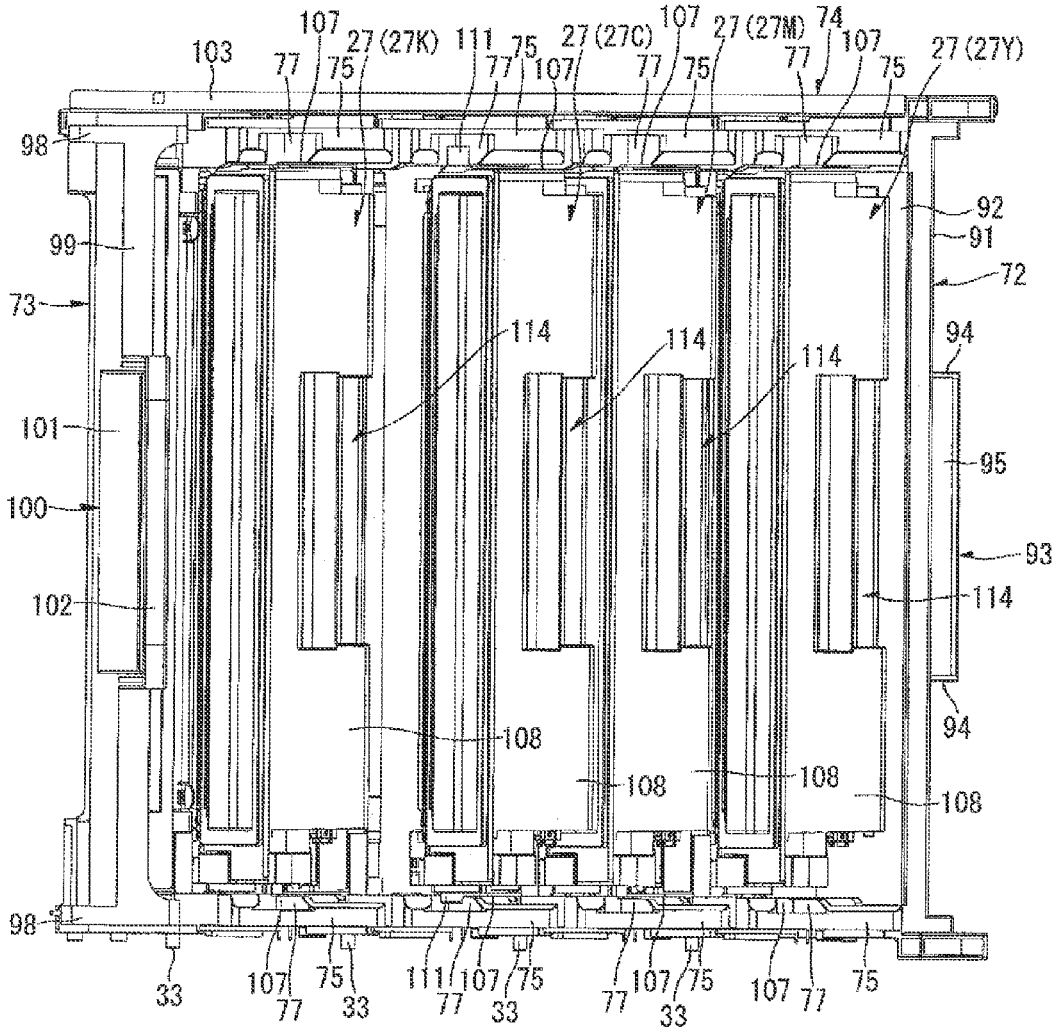
FIG. 7 is a plan view of the drum unit in FIG. 4 with a left side plate removed therefrom.
Figure 8:
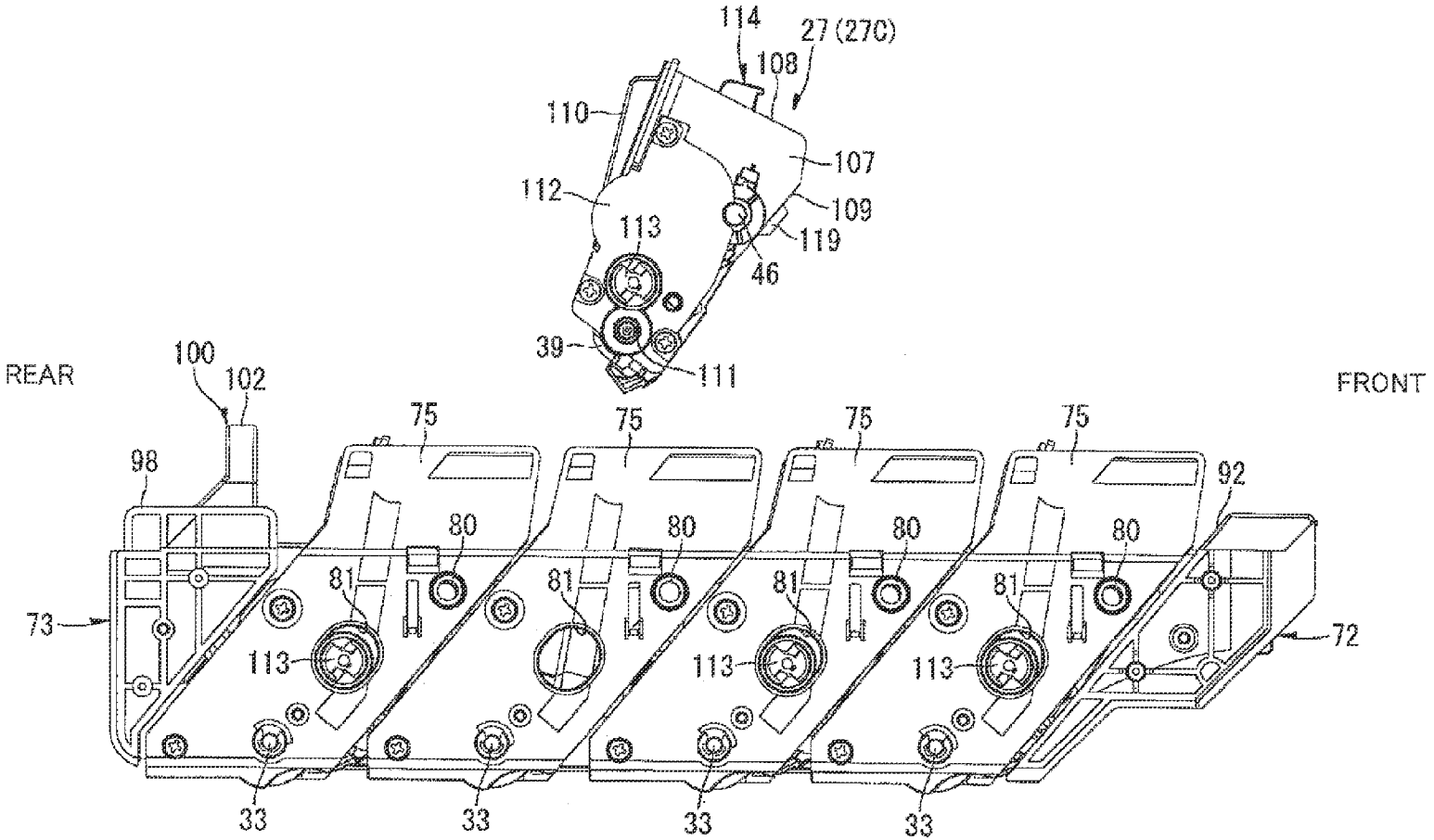
FIG. 8 is a left side view of the drum unit in FIG. 7.
Figure 9:
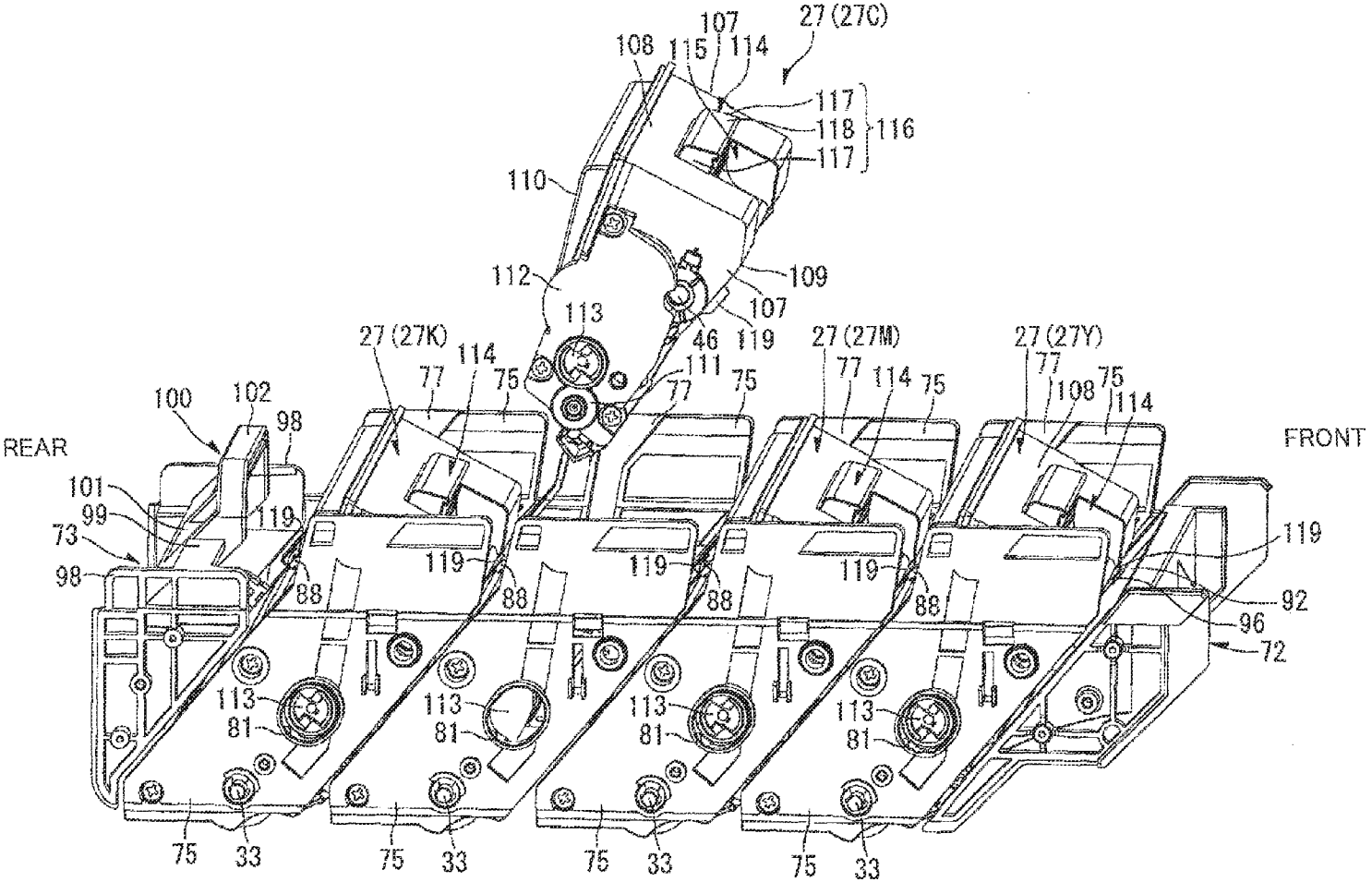
FIG. 9 is a perspective view of the drum unit in FIG. 8 as viewed from the upper left side.

Each drum sub-unit 28 includes the photosensitive drum 29, a Scorotron charger 30, and a cleaning brush 31. The photosensitive drum 29 extends in the left-to-right direction and includes a main drum body 32 and a drum shaft 33. The main drum body 32 is cylindrical in shape and has a positive charging photosensitive layer formed of polycarbonate or the like on its outer surface. The drum shaft 33 extends along the axial direction of the main drum body 32 and freely rotatably supports the main drum body 32. Both ends of the drum shaft 33 in its axial direction are inserted through the side frames 75, 75 as shown in FIGS. 7 to 9 and supported on a pair of side plates 74 (FIG. 3) to be described later so as to be not able to rotate. During printing operations, the photosensitive drum 29 is driven to rotate by a motor (not shown) disposed within the main casing 2.

The charger 30 is disposed diagonally above and rearward of the photosensitive drum 29. The charger 30 opposes the photosensitive drum 29 but is spaced away from the photosensitive drum 29. The charger 30 is supported on the center frame 76 (FIG. 3). The charger 30 includes a discharge wire 34 and a grid 35. The discharge wire 34 is disposed in opposition to the photosensitive drum 29, but is spaced away therefrom. The grid 35 is disposed between the photosensitive drum 29 and the discharge wire 34.

During printing operations, a high voltage is applied to the discharge wire 34 from a high-voltage circuit board (not shown) provided in the main casing 2 through a wire electrode (not shown), such that corona discharge is generated from the discharge wire 34. The high voltage is also applied to the grid 35 from the high-voltage circuit board through a grid electrode (not shown). As a result, the surface of the photosensitive drum 29 is charged to a uniform positive polarity while the amount of charges supplied to the photosensitive drum 29 is controlled.

The cleaning brush 31 is disposed rearward of the photosensitive drum 29 and contacts the same. The cleaning brush 31 is supported on the center frame 76 (FIG. 3). During the printing operations, a cleaning bias is applied to the cleaning brush 31 from the high-voltage circuit board (not shown) through a cleaning electrode (not shown).

Referring to FIG. 1, the developing cartridges 27 are detachably mounted on the corresponding drum sub-units 28 corresponding to respective colors. That is, the developing cartridges 27 include a yellow developing cartridge 27Y detachably mounted on the yellow drum sub-unit 28Y, a magenta developing cartridge 27M detachably mounted on the magenta drum sub-unit 28M, a cyan developing cartridge 27C detachably mounted on the cyan drum sub-unit 28C, and a black developing cartridge 27K detachably mounted on the black drum sub-unit 28K.

As shown in FIG. 2, each developing cartridge 27 includes a developing frame 36, and within the developing frame 36, an agitator 37, a supply roller 38, a developing roller 39, and a thickness regulating blade 40.

The developing frame 36 has a box shape with an opening 41 formed in a bottom portion thereof. A partitioning wall 42 is disposed near the center in the vertical direction of the developing frame 36, partitioning the interior of the developing frame 36 into a toner chamber 43 and a developing chamber 44. The partitioning wall 42 is formed with a connection hole 45 that fluidly connects the toner chamber 43 with the developing chamber 44.

Each toner chamber 43 accommodates toner of a corresponding color. More specifically, the toner chamber 43 of the yellow developing cartridge 27Y accommodates yellow toner, and the toner chamber 43 of the magenta developing cartridge 27M accommodates magenta toner. The toner chamber 43 of the cyan developing cartridge 27C accommodates cyan toner, and the toner chamber 43 of the black developing cartridge 27K accommodates black toner.

Toner in each color is a nonmagnetic, single-component toner having a positive charge. The toner used in the aspects is a polymerized toner obtained by copolymerizing a polymerized monomer using a well-known polymerization method such as suspension polymerization. The polymerized monomer may be, for example, a styrene monomer such as styrene or an acrylic monomer such as acrylic acid, alkyl (C1-C4) acrylate, or alkyl (C1-C4) meta acrylate. The polymerized toner is formed as particles substantially spherical in shape in order to have excellent fluidity.

The toner contains binding resin as a main component. By mixing coloring agents corresponding to each color, charge control agent, and wax with the binding resin, toner mother particles are formed. To improve fluidity, external additives are also added.

The coloring agents of yellow, magenta, cyan, and black are mixed to correspond to each color. As the charge control agent, charge control resin obtained by copolymerizing an ionic monomer having ionic functionality such as ammonium salt and a monomer copolymerizable with the ionic monomer such as styrene monomer or acrylic monomer is mixed. As the external additives, inorganic powders, for example, powders of a metal oxide such as silica, aluminum oxide, titanium oxide, strontium titanate, cerium oxide and magnesium oxide, powders of carbide, and powders of metal salt are mixed.

Figure 13:
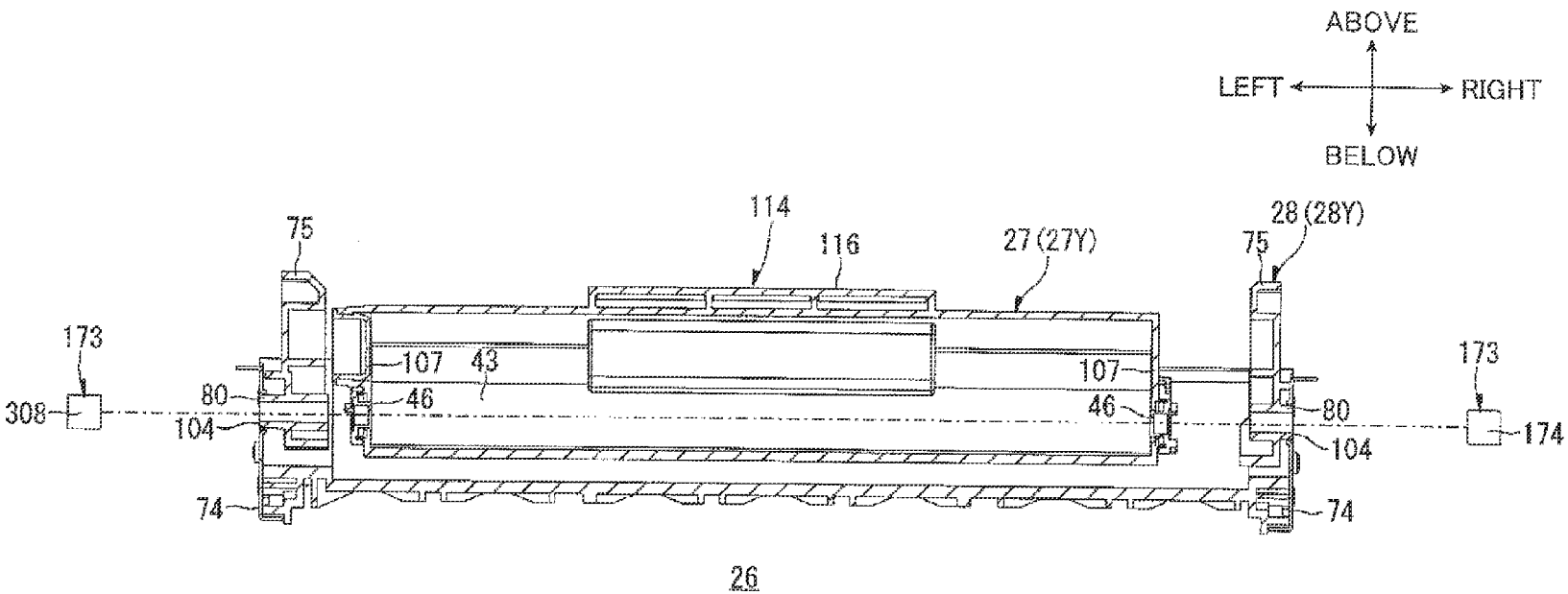
FIG. 13 is a sectional view of the drum unit.

As shown in FIG. 13, the laser printer 1 further includes four optical sensors 173 corresponding to the four developing cartridges 27 for detecting remaining amount of toner accommodated in the corresponding toner chambers 43. Each optical sensor 173 is disposed within the main casing 2 and includes a light emitting element 174 for emitting a detection light and a light receiving element 308 for receiving the detection light.

Figure 19:
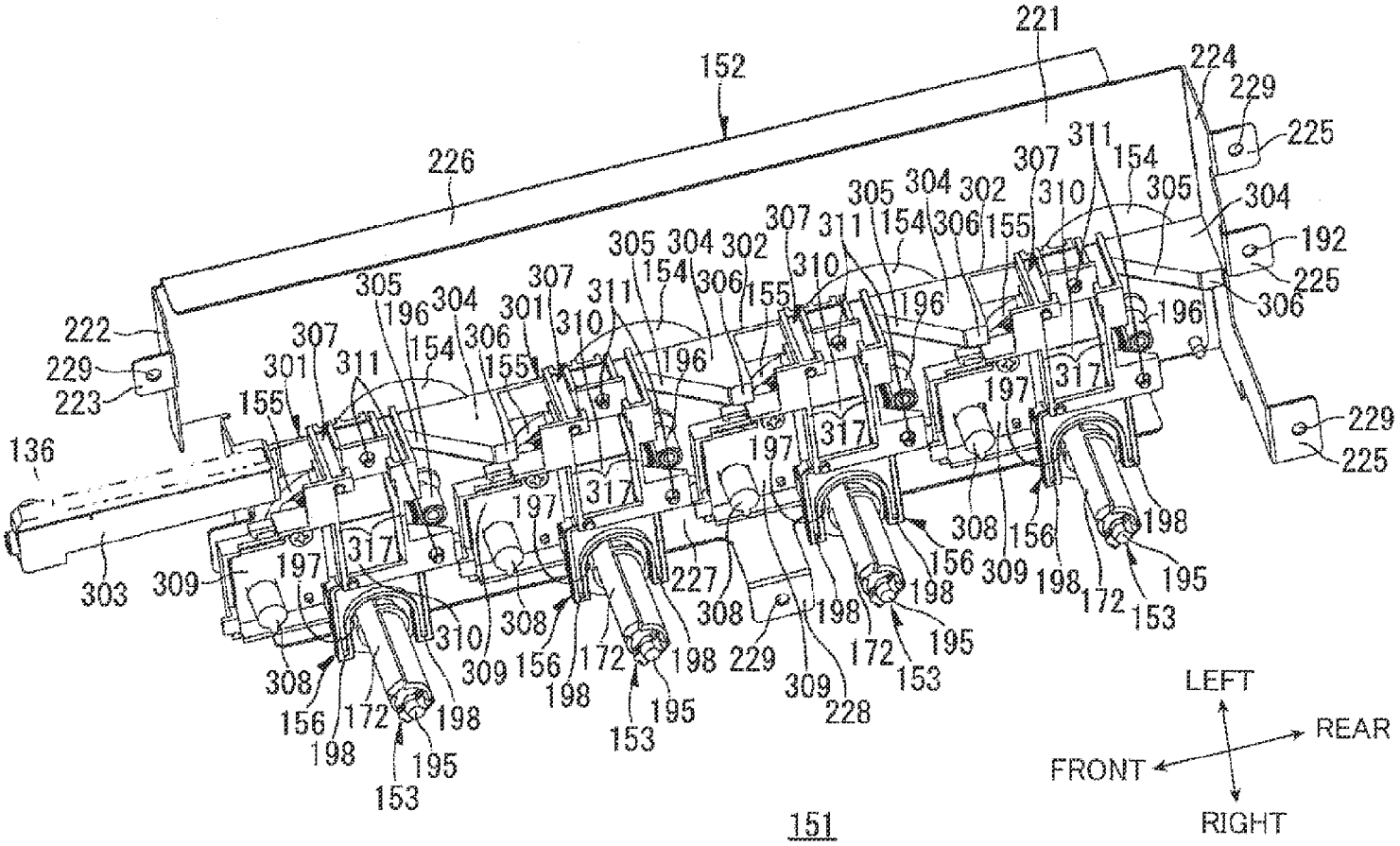
FIG. 19 is a perspective view of a driving force transmitting unit at a rearmost position, as viewed from the upper right.

As shown in FIG. 2, the agitator 37 is disposed inside the toner chamber 43. The agitator 37 includes a rotational shaft 47 and an agitating member 48. The rotational shaft 47 is rotatably supported on side walls 107 (FIG. 5, described later) of the developing frame 36. The agitating member 48 is provided in the axial direction of the rotational shaft 47 and extends outward from the rotational shaft 47 in the radial direction. During the printing operations, a driving force is transmitted to the rotational shaft 47 from a corresponding one of four motors 154 (FIG. 19) provided in the main casing 2 via a corresponding one of coupling female members 113 (FIG. 19). As a result, the agitating member 48 moves circuitously in the toner chamber 43.

The supply roller 38 is disposed inside the developing chamber 44 and below the connection hole 45. The supply roller 38 includes a metal roller shaft 49 covered by a sponge roller 50 formed of an electrically conductive sponge material. The metal roller shaft 49 are rotatably supported on the side walls 107 (FIG. 5) of the developing frame 36. During printing operations, a driving force is applied to the metal roller shaft 49 from the corresponding one of the motors 154 (FIG. 19) via the corresponding one of the coupling female members 113, thereby rotating the supply roller 38.

The developing roller 39 is disposed inside the developing chamber 44 diagonally below and rearward of the supply roller 38. The developing roller 39 includes a metal roller shaft 51 covered by a rubber roller 52 formed of an electrically conductive rubber material. The metal roller shaft 51 are rotatably supported on the side walls 107 (FIG. 5) of the developing frame 36.

The rubber roller 52 is formed of a two-layer: a rubber roller layer made of conductive material containing carbon particles, such as urethane rubber, silicon rubber, or EPDM rubber; and a coating layer coating the surface of the rubber roller layer. The coating layer contains urethane rubber, urethane resin, or polyimide resin as main components.

The developing roller 39 is disposed such that the rubber roller 52 is in pressed contact with the sponge roller 50 of the supply roller 38. The developing roller 39 is exposed downward from the opening 41 of the developing chamber 44. During the printing operations, a driving force of the corresponding motor 154 (FIG. 19) is transmitted to the roller shaft 51 of the developing roller 39 through the corresponding coupling female member 113, thereby rotating the developing roller 39. Also, a developing bias is applied to the roller shaft 51 from the high-voltage circuit board (not shown) through a developing-roller electrode (not shown).

The thickness regulating blade 40 is disposed inside the developing chamber 44 and contacts the developing roller 39 with pressure from the above. The thickness regulating blade 40 includes a blade 53 made of a metal leaf spring and a pressing portion 54 provided on a free end of the blade 53. The pressing portion 54 is formed of an electrically-insulating silicon rubber in a semi-circular shape in cross-section.

A base end of the blade 53 is fixed to the partitioning wall 42 by a fixing member 55. A resilient force of the blade 53 presses the pressing portion 54 on its free end against the rubber roller 52 of the developing roller 39 from the above.

In each of the developing cartridges 27, the toner of the corresponding color accommodated in the toner chamber 43 moves toward the connection hole 45 due to its own weight, and is discharged into the developing chamber 44 through the connection hole 45 while being agitated by the agitator 37.

The toner discharged through the connection hole 45 into the developing chamber 44 is supplied to the supply roller 38, and further to the developing roller 39 by the rotation of the supply roller 38. At this time, the toner is positively tribocharged between the supply roller 38 and the developing roller 39 supplied with the developing bias.

The toner supplied to the developing roller 39 is conveyed to a position between the rubber roller 52 of the developing roller 39 and the pressing portion 54 of the thickness regulating blade 40 by the rotation of the developing roller 39, and is borne in a thin layer with a fixed thickness on the surface of the rubber roller 52.

Meanwhile, in each of the drum sub-units 28, as the photosensitive drum 29 rotates, the charger 30 generates a corona discharge to charge the surface of the photosensitive drum 29 with a uniform positive polarity. Subsequently, a laser beam emitted from the scanner unit 20 is scanned at a high speed over the surface of the photosensitive drum 29, forming an electrostatic latent image corresponding to an image to be formed on the paper 3.

Then, positively charged toner carried on the surface of the developing roller 39 comes into contact with the photosensitive drum 29 as the developing roller 39 rotates and is supplied to areas on the positively charged surface of the photosensitive drum 29 that were exposed to the laser beam and, therefore, have a lower potential. In this way, the electrostatic latent image on the photosensitive drum 29 is transformed into a visible image according to a reverse developing process so that a toner image of a corresponding color is carried on the surface of the photosensitive drum 29.

Note that toner remaining on the photosensitive drum 29 after transfer operations described later is recovered by the developing roller 39. Further, paper dust deposited on the photosensitive drum 29 from the paper 3 is recovered by the cleaning brush 31.

As shown in FIG. 1, the transfer unit 22 is disposed inside the main casing 2 above the feeder unit 4 and below the process unit 21 along the front-to-rear direction. The transfer unit 22 includes a drive roller 56, a driven roller 57, the conveying belt 58, four transfer rollers 59, and a cleaning unit 60.

The drive roller 56 and the driven roller 57 are disposed in opposition with each other and are spaced away from each other in the front-to-rear direction. The drive roller 56 is disposed rearward of the black drum sub-unit 28K, and the driven roller 57 is disposed frontward of the yellow drum sub-unit 28Y.

The conveying belt 58 is an endless belt formed of a resin film made of conductive polycarbonate or polyimide in which conductive particles such as carbon are dispersed. The conveying belt 58 is looped around the drive roller 56 and the driven roller 57.

During the printing operation, the drive roller 56 is driven to rotate by a driving force transmitted from a motor (not shown) disposed inside the main casing 2. When the drive roller 56 rotates, the conveying belt 58 moves circuitously between the drive roller 56 and the driven roller 57, such that the convey belt 58 moves in the same direction as the photosensitive drums 29 at transfer positions where the convey belt 58 contacts the photosensitive drums 29. Also, the driven roller 57 rotates in association with the movement of the convey belt 58.

Each transfer roller 59 is disposed inside the conveying belt 58 in opposition to the corresponding photosensitive drum 29 with the conveying belt 58 interposed therebetween. Each transfer roller 59 includes a metal roller shaft covered by a rubber roller formed of an electrically conductive rubber material. The transfer roller 59 rotates such that the transfer roller 59 moves in the same direction as the conveying belt 58 at the transfer position where the transfer roller 59 contacts the conveying belt 58. During the printing operations, a transfer bias is applied to the transfer roller 59 from the high-voltage circuit board (not shown).

The cleaning unit 60 is disposed below the conveying belt 58 and includes a primary cleaning roller 61, a secondary cleaning roller 62, a scraping blade 63, and a toner accommodating chamber 64. The primary cleaning roller 61 is disposed so as to contact a lower portion of the conveying belt 58, which is opposite to an upper portion of the conveying belt 58 where the photosensitive drums 29 and the transfer rollers 59 contact. The primary cleaning roller 61 rotates such that the primary cleaning roller 61 moves in the same direction as the conveying belt 58 at a point of contact. During the printing operations, a primary cleaning bias is applied to the primary cleaning roller 61 from the high-voltage circuit board (not shown).

The secondary cleaning roller 62 is disposed so as to contact the primary cleaning roller 61 from below, and to rotate such that the secondary cleaning roller 62 moves in the same direction as the primary cleaning roller 61 at a point of contact. During the printing operations, a secondary cleaning bias is applied to the secondary cleaning roller 62 from the high-voltage circuit board (not shown).

The scraping blade 63 contacts the secondary cleaning roller 62 from below. The toner accommodating chamber 64 is disposed below the primary cleaning roller 61 and the secondary cleaning roller 62 so as to store the toner falling from the secondary cleaning roller 62.

The sheet of paper 3 fed from the feeder unit 4 is conveyed by the conveying belt 58 so as to sequentially pass the transfer positions of the respective drum sub-units 28 from the front side toward the rear side. During the conveyance, toner images carried on the photosensitive drums 29 of the drum sub-units 28 are sequentially transferred onto the sheet of paper 3, thereby forming a color image on the paper 3.

That is, for example, a yellow toner image carried on the surface of the photosensitive drum 29 of the yellow drum sub-unit 28Y is first transferred on the sheet 3. Next, a magenta toner image carried on the surface of the photosensitive drum 29 of the magenta drum sub-unit 28M is transferred onto the yellow toner image that has been transferred onto the sheet of paper 3 in an overlapping manner. Subsequently, by the similar operation, a cyan toner image carried on the surface of the photosensitive drum 29 of the cyan drum sub-unit 28C and a black toner image carried on the surface of the photosensitive drum 29 of the black drum sub-unit 28K are transferred in an overlapping manner, thereby forming a color image on the paper 3.

Toner deposited on the surface of the conveying belt 58 during the transfer operation is first transferred onto the primary cleaning roller 61 by the primary cleaning bias, and then onto the secondary cleaning roller 62 by the secondary cleaning bias. Thereafter, the toner on the secondary cleaning roller 62 is scraped off by the scraping blade 63, and falls into the toner accommodating chamber 64.

The fixing unit 23 is disposed rearward of the black drum sub-unit 28K and opposes the transfer position in the front-to-rear direction. The fixing unit 23 includes a heat roller 65 and a pressure roller 66.

The heat roller 65 is formed of a metal tube on which a release layer is formed, and has a halogen lamp disposed in the metal tube along the axial direction thereof. The surface of the heat roller 65 is heated to a fixing temperature by the halogen lamp. The pressure roller 66 disposed below the heat roller 65 and presses the heat roller 65 from the bottom.

The color image transferred onto the paper 3 is thermally fixed onto the paper 3 as the paper 3 passes between the heat roller 65 and the pressure roller 66.

A discharge-side conveying path 67 is formed in the discharge unit 6. An upstream end of the discharge-side conveying path 67 in the sheet conveying direction is adjacent to the fixing unit 23 disposed to a lower position, and a downstream end thereof is adjacent to a discharge tray 68 disposed at a higher position. The discharge-side conveying path 67 is formed in a substantially U-shape in a side view so that the sheet of paper 3 is fed toward the rear, reversed, and then discharged toward the front.

A convey roller 69 and a pinch roller 70 are disposed along the discharge-side conveying path 67 in opposition with each other. A pair of discharge rollers 71 is disposed at the downstream end of the discharge-side conveying path 67. The discharge unit 6 is provided with the discharge tray 68. The discharge tray 68 is formed on the upper wall of the main casing 2 so as to gradually become depressed from the front side toward the rear side. The discharge tray 68 is for supporting the discharged sheets of paper 3 in a stacked manner.

The sheet of paper 3 discharged from the fixing unit 23 is conveyed along the discharge-side conveying path 67 by the convey roller 69 and the pinch roller 70, and is discharged by the discharge rollers 71 onto the discharge tray 68.

As shown in FIG. 3, the drum unit 26 includes the four drum sub-units 28, a front beam 72 disposed to the front of the drum sub-units 28, a rear beam 73 disposed to the rear of the drum sub-units 28, and the pair of side plates 74 sandwiching the drum sub-units 28, the front beam 72, and the rear beam 73 therebetween in the width (right-to-left) direction.

The drum unit 26 (that is, all of the four drum sub-units 28, the front beam 72, the rear beam 73, and the pair of side plates 74, in an integral manner) is slidably mounted to and removed from the drum accommodating area 7 in the main casing 2.

Each of the drum sub-units 28 has a pair of side frames 75 disposed in opposition to but spaced away from each other in the width direction, and a center frame 76 extending between the side frames 75.

As shown in FIG. 8, the side frames 75 are made of a resin material and shaped like a parallelogram which is inclined from the upper front side toward the lower rear side.

As shown in FIG. 3, guide grooves 77 are formed in inner surfaces of the side frames 75 facing each other in the width direction. Each guide groove 77 is depressed from the inner surface of the side frame 75 toward the outside in the width direction so as to have a C-shaped cross section.

Figure 10:
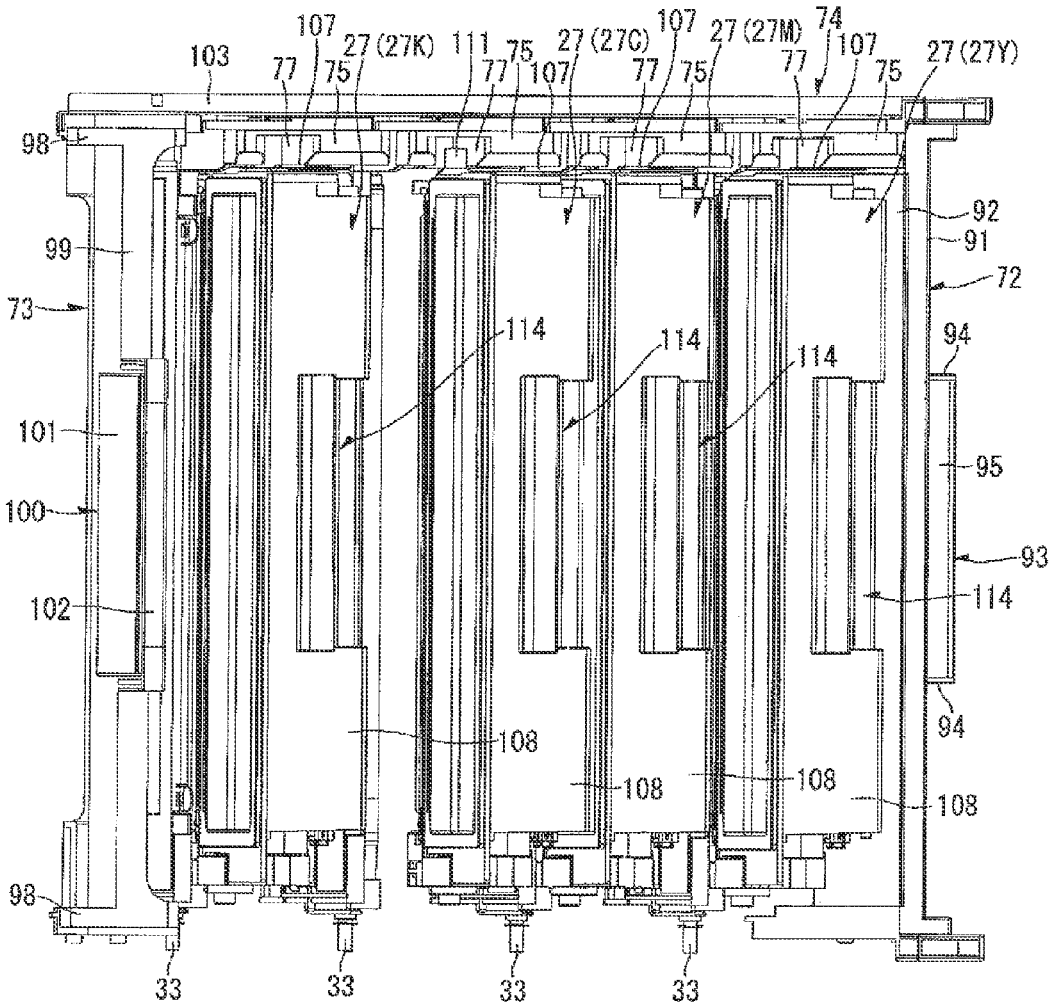
FIG. 10 is a plan view of the drum unit in FIG. 4 with the left side plate and a left side frame removed therefrom.
Figure 11:
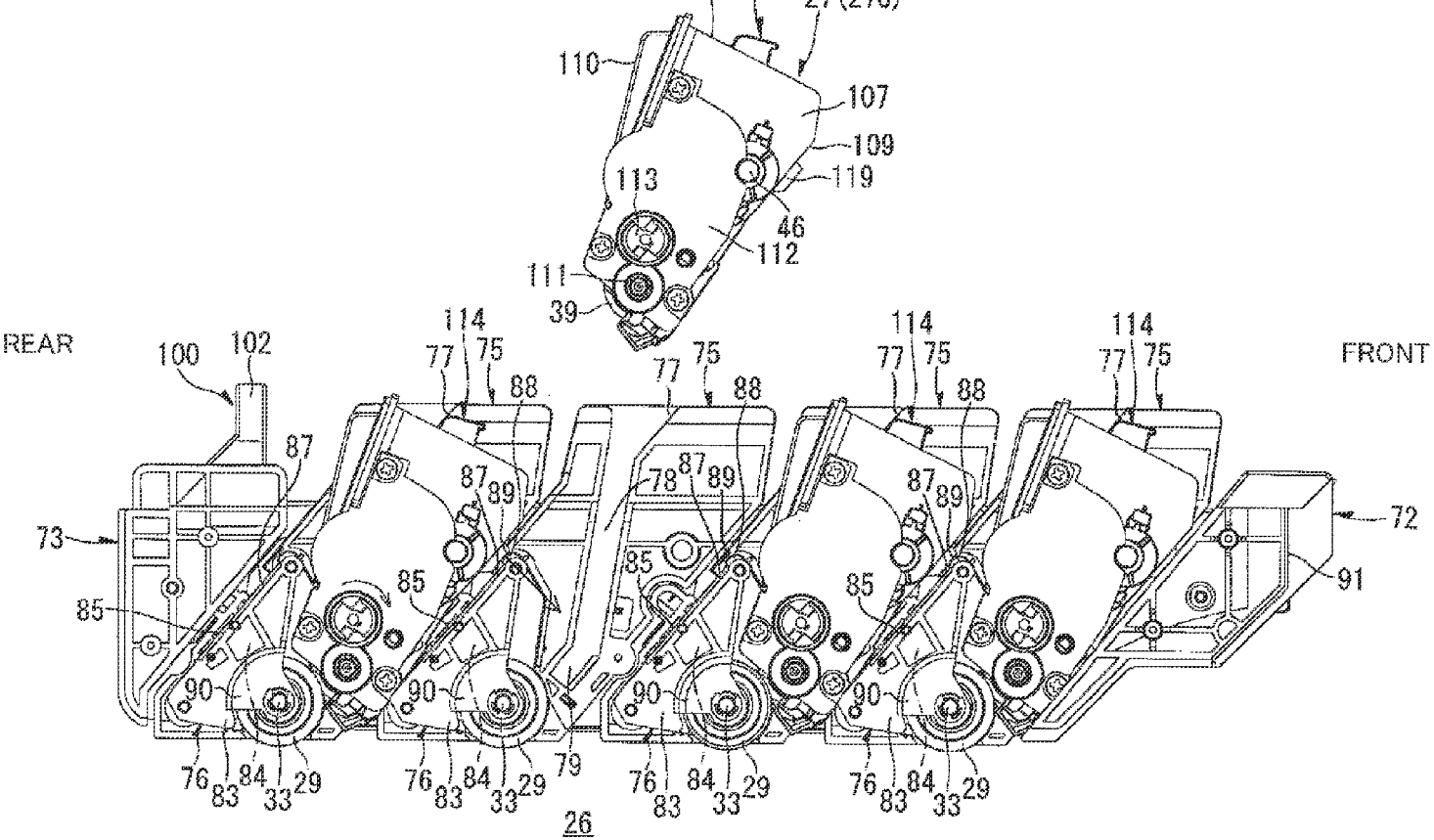
FIG. 11 is a left side view of the drum unit in FIG. 10.

FIGS. 10 and 11 are a plan view and a left side view, respectively, of the drum unit 26 with the left side plate 74 and the left side frame 75 are removed therefrom. As shown in FIG. 11, the guide groove 77 is formed from the upper edge of the side frame 75 to the vicinity of the lower front end thereof along the substantially vertical direction. More specifically, the guide groove 77 is open on the top, and a front edge of the upper section of the guide groove 77 slants upward toward the front such that the guide groove 77 is wider toward the above. The guide groove 77 has an upper guide part 78 which is open on the top and extends in the substantially vertical direction, and a lower guide part 79 which is formed in continuous with the lower section of the upper guide part 78 and inclines downward toward the rear.

As shown in FIG. 8, each side frame 75 is formed with a cylindrical boss 80 that protrudes outward from the outer surface of the side frame 75 in the width direction, at an upper section of the side frame 75 to the front of the guide groove 77.

Each of the left side frames 75 is further formed with a coupling inner inserting hole 81 in the middle of the guide groove 77. The coupling inner inserting hole 81 penetrates through the left side frame 75 in the thickness direction (width direction of the laser printer 1) and is oval having a slightly longer diameter in a direction substantially parallel to the lower guide part 79 (FIG. 11) of the guide groove 77.

The center frames 76 (FIG. 3) are made of a resin material and formed separately from the side frames 75. Each of the center frames 76 has, as shown in FIG. 12, a center plate 82 extending in the width direction and side inner plates 83 integrally formed with the center plate 82 at the left and right ends of the center plate 82.

The center plate 82 is shaped like an elongated plate in a plan view. An upper surface 87 of the center plate 82 inclines downward toward the rear so as to extend substantially in parallel with the lower guide part 79 of the guide groove 77. A charger holding part 84 for holding the charger 30 is formed at the middle of the center plate 82 in the vertical direction so as to extend in the width direction.

As shown in FIG. 2, the discharge wire 34 extends in the width direction within the charger holding part 84, and the grid 35 is held below the discharge wire 34. As shown in FIG. 12, the upper side of the charger holding part 84 is covered with a charging cover 85 extending along the upper surface 87 of the center plate 82.

Figure 12:
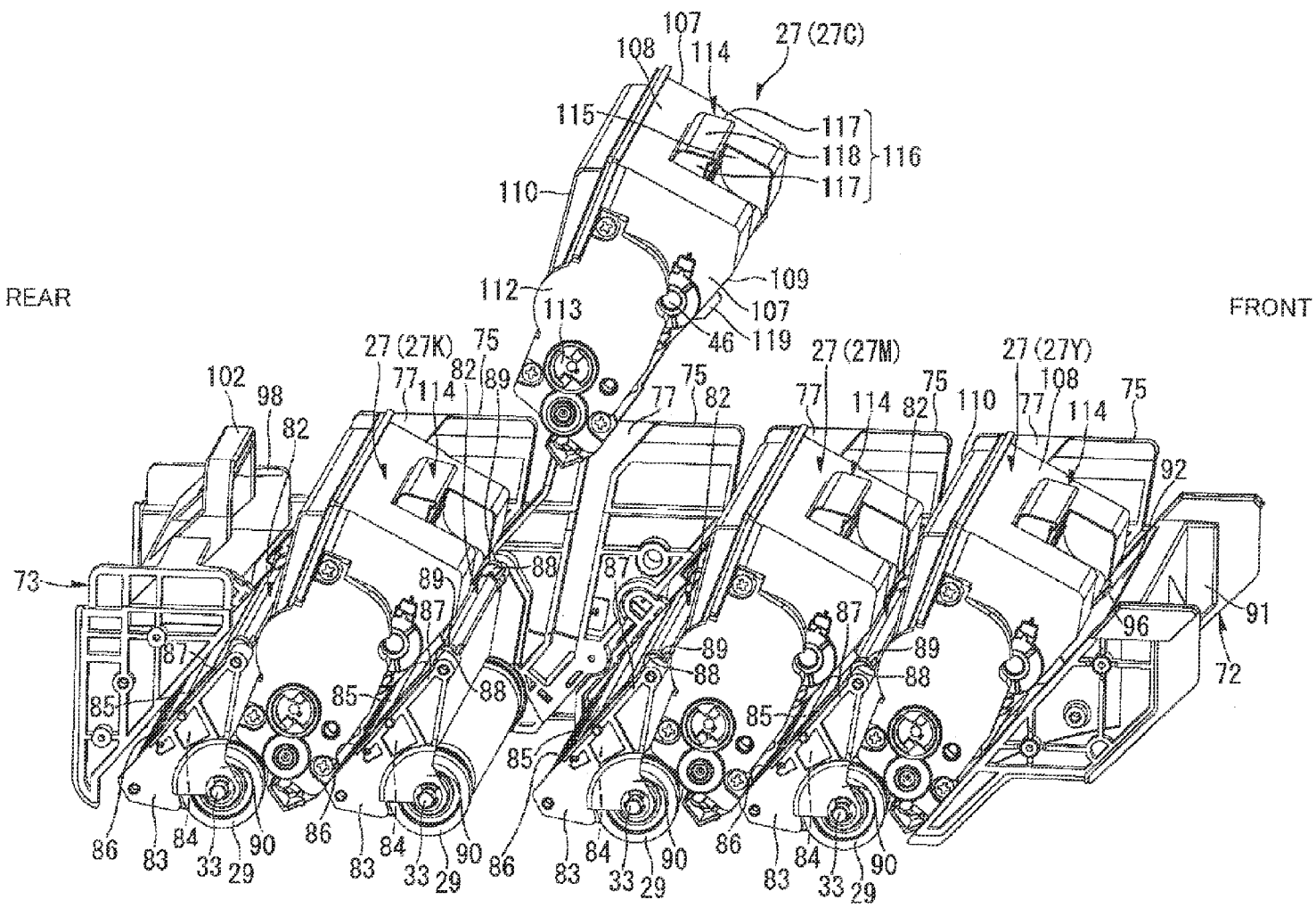
FIG. 12 is a perspective view of the drum unit in FIG. 10 as viewed from the upper left side.

As shown in FIG. 12, the center plate 82 is provided with a brush holding member 86 below the charger holding part 84. The brush holding member 86 holds the cleaning brush 31 shown in FIG. 2 along the width direction.

As shown in FIGS. 3 and 12, two supporting members 88 are disposed on the upper end of the upper surface 87 of the center plate 82 of each of the drum sub-units 28Y, 28M, and 28C except the drum sub-unit 28K. The supporting members 88 are disposed at an interval in the width direction. Each supporting member 88 is shaped like a semicircle in a side view so as to protrude diagonally upward. A friction reducing tape 89 made of a material having a lower friction coefficient than the resin material for the center plate 82 is adhered to the surface of each supporting member 88.

The side inner plates 83 shown in FIG. 12 are formed by bending the left and right end portions of the center plates 82 toward the front. Each side inner plate 83 is formed substantially in the shape of a triangle in a side view with a narrower width toward the front. A shaft inserting part 90 for inserting the drum shaft 33 therein is formed at the front end of each side inner plate 83.

As shown in FIG. 3, the front beam 72 is integrally formed with the pair of side plates 74 and stretched between the side plates 74. The front beam 72 is formed of a resin material and has a front outer wall 91 and a front inner wall 92.

The front outer wall 91 is shaped like a substantially rectangular elongated plate in a front view and extends in the width and vertical directions. A front grip part 93 is provided at the center of the front outer wall 91 in the width direction. The front grip part 93 has a pair of side plates 94 and a center plate 95. The side plates 94 are disposed in opposition to but spaced away from each other in the width direction.

Each side plate 94 is shaped like a substantially triangle plate in a side view so as to protrude diagonally downward toward the front from the front surface of the front outer wall 91.

The center plate 95 extends between lower ends of the side plates 94. A front end of the center plate 95 is bent upward so as to form an L-shaped cross section.

The front inner wall 92 is disposed to the rear of the front outer wall 91. The front inner wall 92 is shaped like a substantially rectangular elongated plate in a rear view and extends in the width direction. The front inner wall 92 is inclined in a direction substantially parallel to the upper surfaces 87 of the center plates 82 of the center frames 76 (FIG. 12).

Two supporting members 96 are disposed on an upper section of the front inner wall 92 at positions spaced away from each other in the width direction. The supporting members 96 are formed to be substantially semicircular in a side view so as to protrude diagonally upward. More specifically, the supporting members 92 protrude toward the yellow developing cartridge 27Y mounted to the corresponding drum sub-unit 28A. A friction reducing tape 97 made of a material having a lower friction coefficient than the resin material for the front beam 72 is adhered to the surface of each supporting member 96.

The rear beam 73 extends between the pair of side plates 74. The rear beam 73 is formed of a resin material integrally with the side plates 74. The rear beam 73 has a pair of rear side walls 98 disposed in opposition to each other in the width direction, a rear center wall 99 extending between the rear side walls 98, and a grip member 100 formed on the rear center wall 99.

The rear grip member 100 has a recessed part 101 formed in a C-shape in a rear view by recessing an upper end of the rear center wall 99 downward, and a rear handle 102 having a substantial C-shape in a rear view. The rear handle 102 protrude upward from the upper end of the rear center wall 99 so as to stretch over the recessed part 101 in the width direction.

The side plates 74 are made of a material (for example, metal or fiber reinforced resin, preferably metal) having a lower linear expansion coefficient than the resin material for the drum sub-units 28. The side plates 74 are shaped like a substantially rectangular elongated plate in a side view and extend in the front-to-rear direction. The side plates 74 are opposed to the front beam 72 at front ends and to the rear beam 73 at rear ends.

The upper end of each side plate 74 is bent outward in the width direction, forming a collar part 103, such that the side plate 74 has an L-shaped cross section. That is, the collar part 103 extends outward in the width direction along the front-to-rear direction of the side plate 74. The collar part 103 is slidably fitted into a rail (not shown) provided in the main casing 2.

Figure 5:
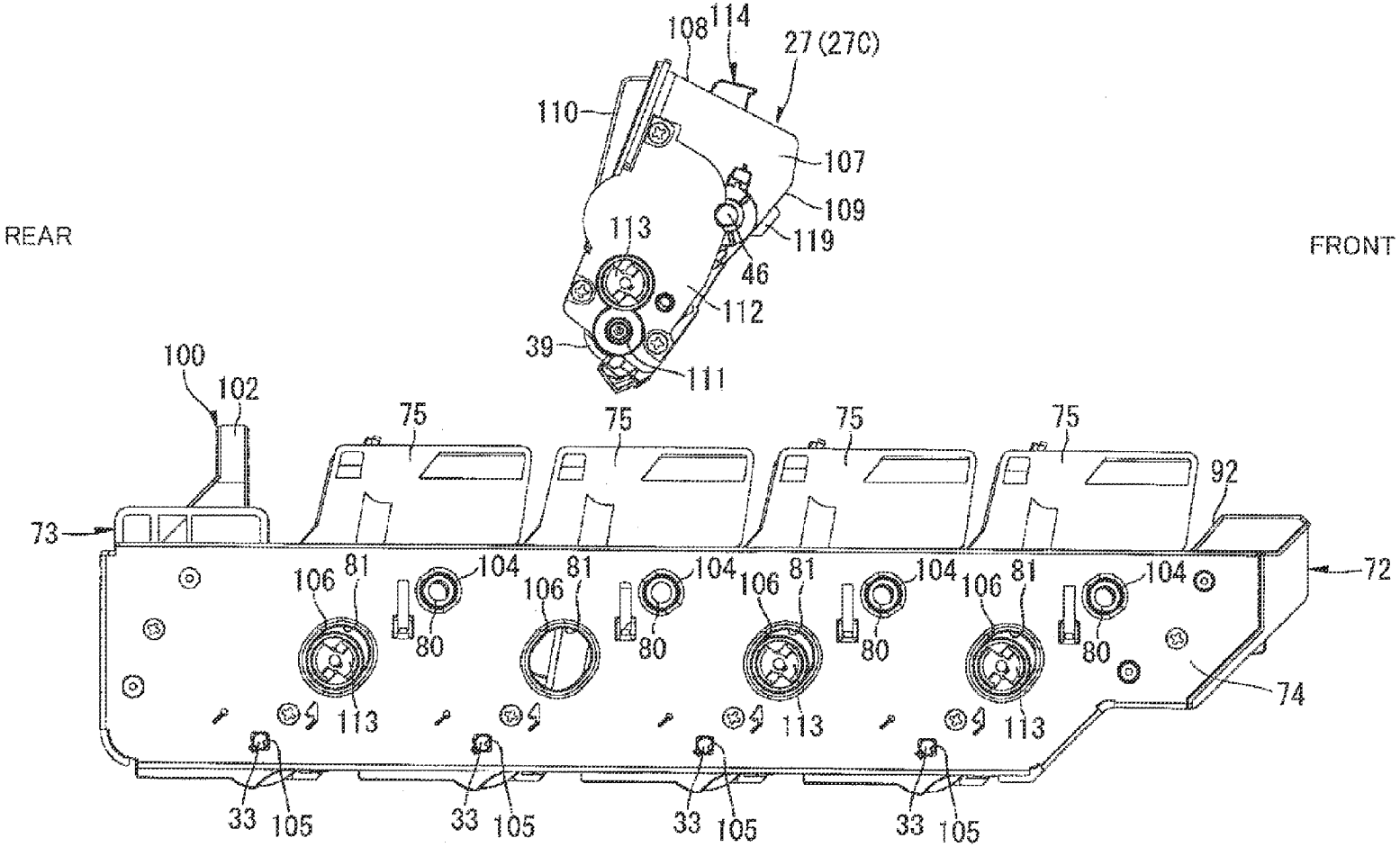
FIG. 5 is a left side view of the drum unit in FIG. 4.

As shown in FIG. 5, four light transmitting holes 104 are formed in each side plate 74 at the upper end thereof. The light transmitting holes 104 are aligned at intervals in the front-to-rear direction. Each of the light-transmitting holes 104 is formed as a round hole which penetrates through the side plate 74 in the thickness direction thereof. The light-transmitting holes 104 receive the bosses 80 of the corresponding drum sub-units 28 in the state where the side frames 75 are assembled to the drum sub-units 28.

Four shaft holes 105 are formed in each side plate 74 at the lower end. The shaft holes 105 are aligned at intervals in the front-to-rear direction. Each shaft hole 105 is formed as a square hole which penetrates through the side plate 74 in the thickness direction. A shaft end of the drum shaft 33 of each photosensitive drum 29 is inserted into the shaft hole 105.

Four coupling outer inserting holes 106 are formed in the left side plate 74 at centers in the vertical direction. The coupling outer inserting holes 106 are aligned at intervals in the front-to-rear direction. Each coupling outer inserting hole 106 penetrates through the left side plate 74 in the thickness direction and is formed as an oval hole which is slightly longer in a direction substantially parallel to the lower guide part 79 of the guide groove 77 formed in each side frame 75 (FIG. 11).

With this configuration, the coupling outer inserting holes 106 oppose the corresponding coupling inner inserting holes 81 of the left side frame 75 in the width direction in the state where the side frames 75 are assembled to the drum sub-units 28. Also, the coupling outer inserting holes 106 oppose the coupling female members 113 of the developing cartridges 27 in the width direction in the state where the side frames 75 are assembled to the drum sub-units 28 and the developing cartridges 27 are attached to the drum sub-units 28.

Figure 6:
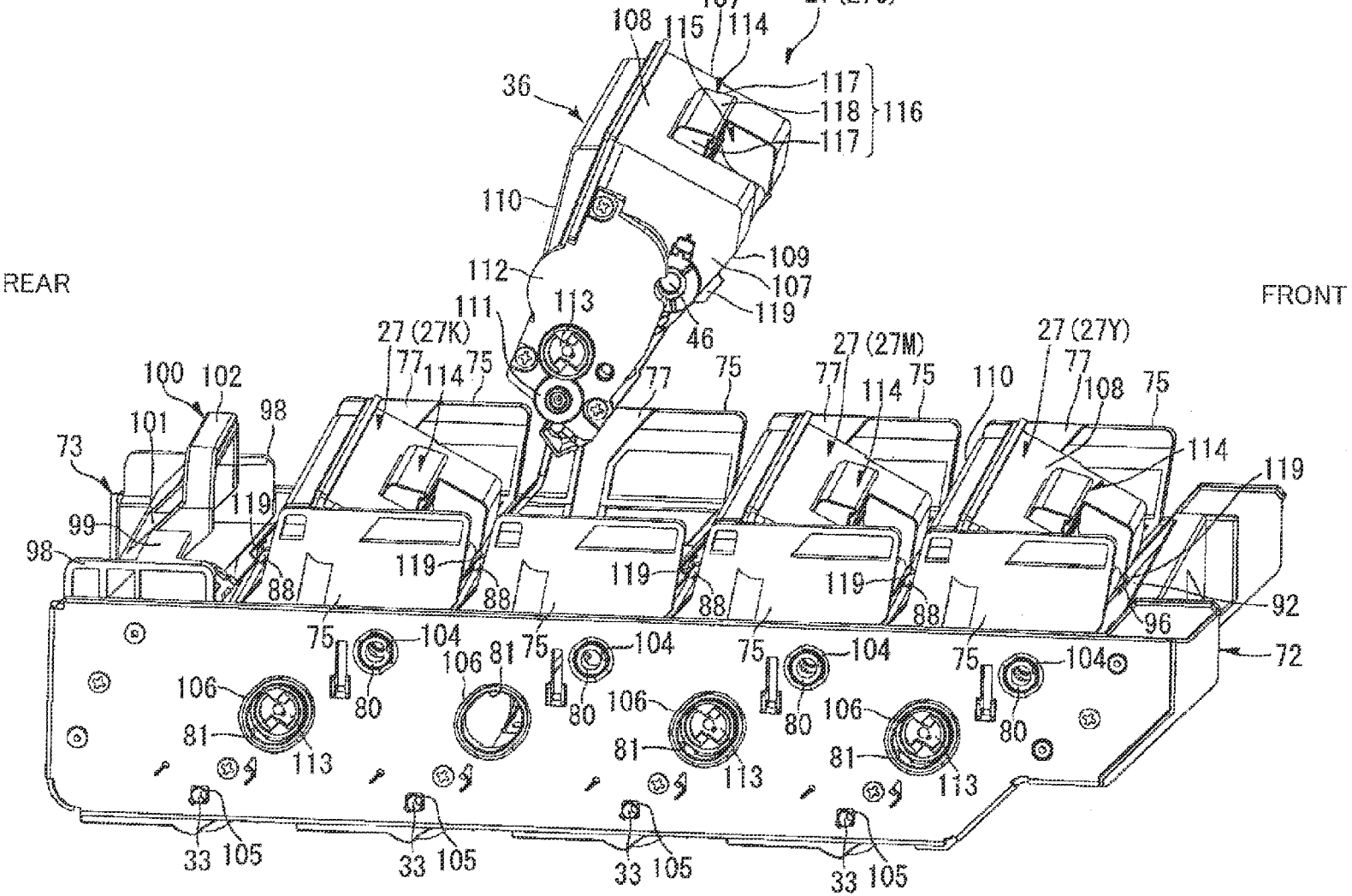
FIG. 6 is a perspective view of the drum unit in FIG. 4 as viewed from the upper left side.

The developing cartridges 27 will be described next. As shown in FIG. 6, the developing frame 36 of each developing cartridge 27 includes a pair of side walls 107 in opposition to each other in the width direction, an upper wall 108 extending between upper edges of the side walls 107, a front wall 109 extending between front edges of the side walls 107, and a rear wall 110 extending between rear edges of the side walls 107, all formed integrally one another. Lower edges of the side walls 107, the front wall 109, and the rear wall 110 together define the opening 41 shown in FIG. 2 through which the developing roller 39 is exposed.

Figure 4:
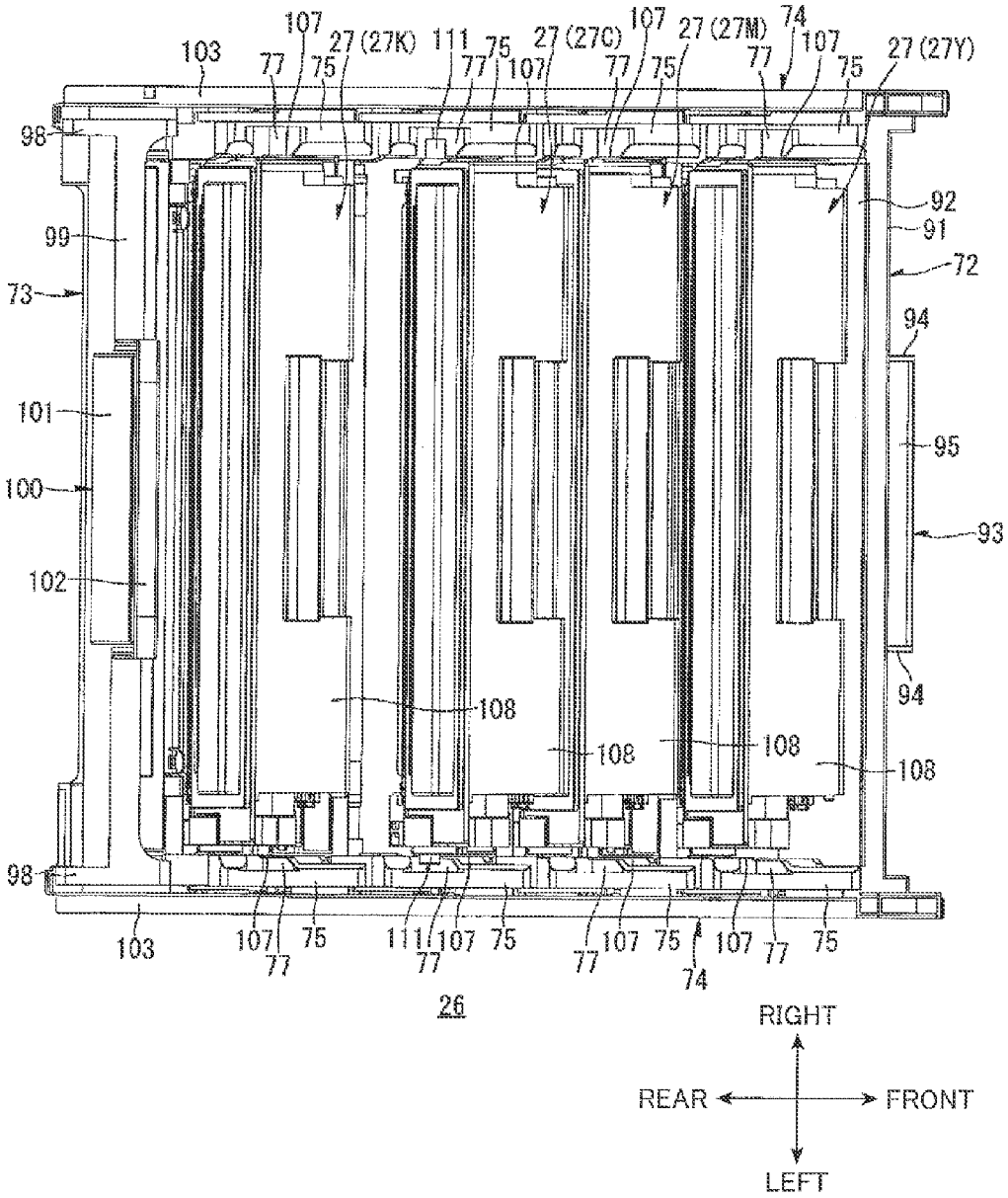
FIG. 4 is a plan view of the drum unit in FIG. 3 with four developing cartridges attached thereto.

The roller shaft 51 (FIG. 2) of the developing roller 39 is rotatably supported by the side walls 107 of the developing frame 36, such that both axial ends of the roller shaft 51 protrude outward in the width direction from the side walls 107 of the developing frame 36. Each of the axial ends of the roller shaft 51 is covered with a conductive collar member 111 shown in FIG. 4.

As shown in FIG. 2, windows 46 are buried one in either side wall 107 for detecting remaining amount of the toner in the toner chamber 43. As shown in FIG. 13, the windows 46 are disposed in opposition to each other, one on either side of the toner chamber 43 with respect to the width direction. The windows 46 allow the passage of the detection light from the light emitting element 174 toward the light receiving element 308 in the width direction. As shown in FIG. 2, each of the windows 46 is located on a straight line L passing through the rotational shaft 47 of the agitator 37 and a projecting member 119 described later and at a position closer to the projecting member 119 than to the rotational shaft 47.

A gear mechanism (not shown) covered with a gear cover 112 shown in FIG. 5 is disposed on the left side wall 107. The gear mechanism has the coupling female member 113 exposed from the gear cover 112 and a gear train (not shown) engaging with the coupling female member 113.

The gear train (not shown) has an agitator driving gear fixed to the rotational shaft 47 of the agitator 37, a supply-roller driving gear fixed to the roller shaft 49 of the supply roller 38, and a developing-roller driving gear fixed to the roller shaft 51 of the developing roller 39, all engaged with the coupling female member 113 via intermediate gears or the like.

As will be described later, the coupling female member 113 is connected to a coupling male member 153 (FIG. 19) so as to freely advance or retract but so as not to rotate with respect to the coupling male member 153. A driving force from the corresponding motor 154 (FIG. 19) is transmitted to the coupling male member 153.

As shown in FIG. 6, a developing cartridge grip member 114 is provided at the center of the upper wall 108 in the width direction. The developing cartridge grip member 114 has a concave part 115 formed by recessing the upper wall 108 and a handle 116 provided at a rear end of the concave part 115 so as to extend in the width direction.

The concave part 115 has a substantially rectangular shape in a plan view and is open on the front, that is, on the side opposing the developing cartridge 27 neighboring to the front of the concave part 115 when the developing cartridge 27 is attached to the drum unit 26.

The handle 116 has side walls 117 and a center wall 118. Each of the side walls 117 is shaped like a triangle in a side view having a narrower width toward the rear. The side walls 117 extend upward from left and right ends of the concave part 115 so as to sandwich the concave part 115 therebetween in the width direction. The center wall 118 extends between upper edges of the side walls 117.

Thus, the user can place his/her finger on an inner surface of the center wall 118 from the front along the concave part 115 and pull out the developing cartridge 27 upward.

As shown in FIGS. 2 and 3, the projecting members 119 are formed on the front wall 109 at an interval in the width direction, at positions on the straight line L passing through the window 46 and the rotational shaft 47 of the agitator 37 as viewed from the side. As shown in FIG. 5, each of the projecting members 119 protrudes forward from the front wall 109 to be shaped like a substantially trapezoidal plate in a side view.

Each developing cartridge 27 is attached to the corresponding drum sub-unit 28 from above as follows.

That is, the collar members 111 (FIG. 6) at the left and right ends of the roller shaft 51 of the developing cartridge 27 are inserted into the guiding grooves 77 of the corresponding drum sub-unit 28. The developing cartridge 27 is pressed downward with respect to the drum sub-unit 28 so that the collar members 111 slide along the guiding grooves 77. When the collar members 111 come into contact with deepest parts of the guide grooves 77, the developing cartridge 27 is prevented from being further pressed, and the developing roller 39 (FIG. 2) comes into contact with the corresponding photosensitive drum 29 (FIG. 2).

Due to the weight of the developing cartridge 27, the developing cartridge 27 pivots about the roller shaft 51 (collar members 111) such that an upper end of the developing cartridge 27 falls forward to lean against the center frame 76 or the front beam 72 (FIG. 3) that is neighboring to the front of the developing cartridge 27. By this, the projecting members 119 formed on the front wall 109 of the developing frame 36 are supported by and contact the supporting members 88 or 96 of the center frame 76 or the front beam 72 via the friction reducing tape 89 or 97. At the same time, the collar members 111 come into contact with the upper surfaces of the lower guide parts 79 of the guide grooves 77. In this manner, the developing cartridge 27 is positioned with respect to the drum sub-unit 28 and attached to the drum sub-unit 28.

When the developing cartridge 27 is attached to the corresponding drum sub-unit 28 in this manner, as shown in FIG. 13, the left window 46 buried in the left side wall 107 of the developing frame 36 opposes the boss 80 formed on the left side frame 75 and the light transmitting hole 104 formed on the left side plate 74 in the width direction. Also, the right window 46 buried in the right side wall 107 of the developing frame 36 opposes the boss 80 formed on the right side frame 75 and the light transmitting hole 104 formed in the right side plate 74 in the width direction. Thus, the detection light emitted from the light emitting element 174 of the optical sensor 173 can pass the left light-transmitting hole 104, the left boss 80, the left window 46, the toner chamber 43, the right boss 80, and the right light transmitting hole 104 in this order, and enter the light receiving element 308.

Further, as shown in FIG. 5, the coupling female member 113 exposed from the gear cover 112 opposes the coupling inner inserting hole 81 formed in the left side frame 75 and the coupling outer inserting hole 106 formed in the left side plate 74 in the width direction. Thus, the coupling male member 153 shown in FIG. 19 can advance to or retract from the coupling female member 113 via the coupling outer inserting hole 106 and the coupling inner inserting hole 81. In the state where the coupling male member 153 is coupled to the coupling female member 113, the agitator 37, the supply roller 38, and the developing roller 39 can be driven by applying a driving force from the motor 154 (FIG. 19) to the coupling female member 113 via the coupling male member 153. At this time, rotation moment is generated in the developing cartridge 27. The direction of the rotation moment is substantially the same as a direction of force applied by the projecting members 119 to the supporting members 88 or 96 due to gravity. For this reason, due to the rotation moment generated in the developing cartridge 27, the projecting members 119 are further pressed against the supporting members 88 or 96, and the collar members 111 are also further pressed against the upper surfaces of the lower guide parts 79 of the guide grooves 77. Thereby, the developing cartridge 27 is surely positioned with respect to the corresponding drum sub-unit 28.

Figure 16:
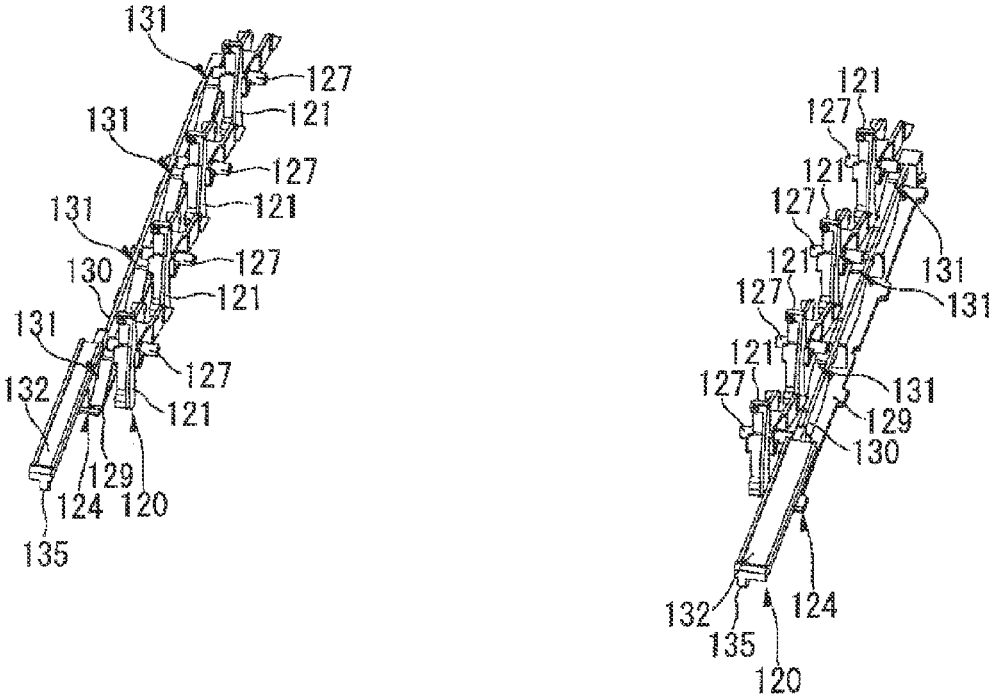
FIG. 16 is a perspective view of the pressing mechanisms in FIG. 14 as viewed from the upper right front.

As shown in FIG. 16, the laser printer 1 further includes a pair of pressing mechanisms 120 for pressing each developing cartridge 27 toward a direction in which the developing roller 39 presses against the photosensitive drum 29 in the state where the developing cartridge 27 is attached to the drum unit 26 (corresponding drum sub-unit 28).

Figure 14:
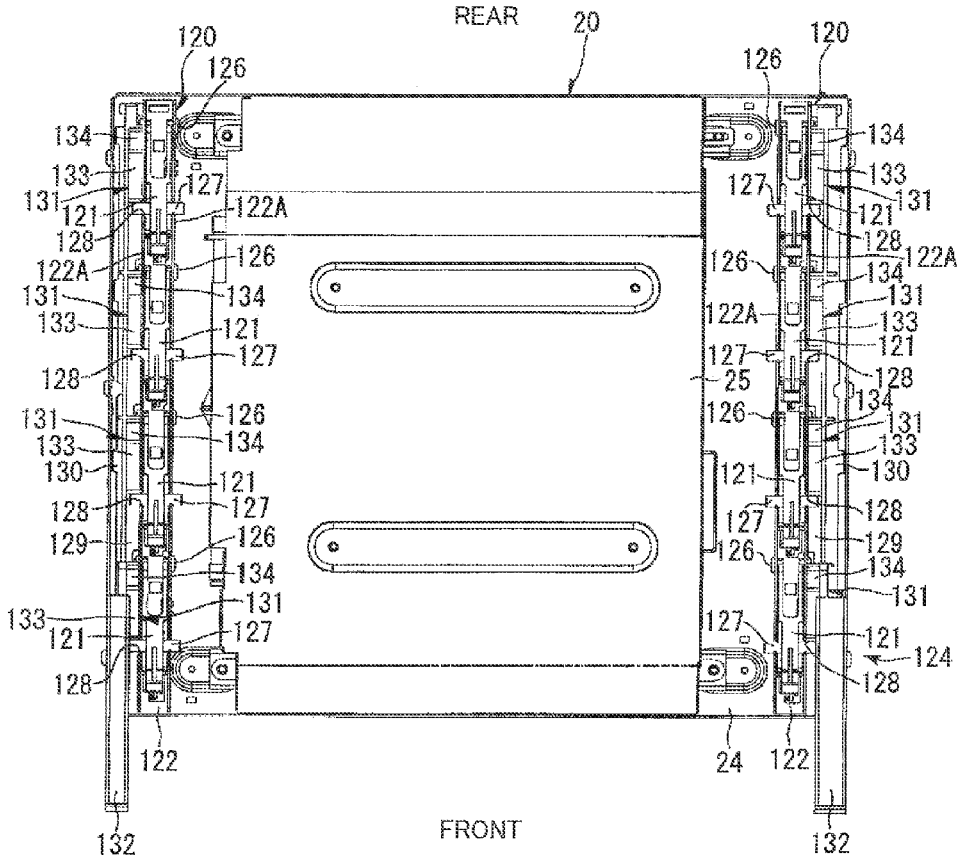
FIG. 14 is a plan view of a scanner unit and a pair of pressing mechanisms of the laser printer in FIG. 1.
Figure 15:
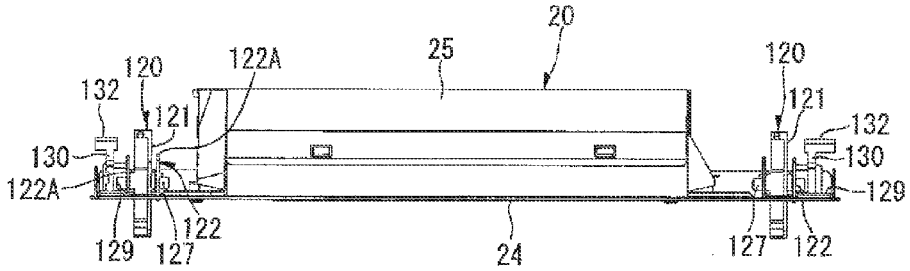
FIG. 15 is a front view of the scanner unit and the pressing mechanisms in FIG. 14.

As shown in FIGS. 14 and 15, the pressing mechanisms 120 are disposed in opposition to each other in the width direction, one on either side of the scanner 25 of the scanner unit 20. The pressing mechanisms 120 are supported by the base plate 24 of the scanner unit 20.

As shown in FIG. 14, each pressing mechanism 120 includes a holding member 122, four pressing members 121, four coil springs 123 (FIG. 17) and a pressing member direct-acting cam 124.

Figure 26:
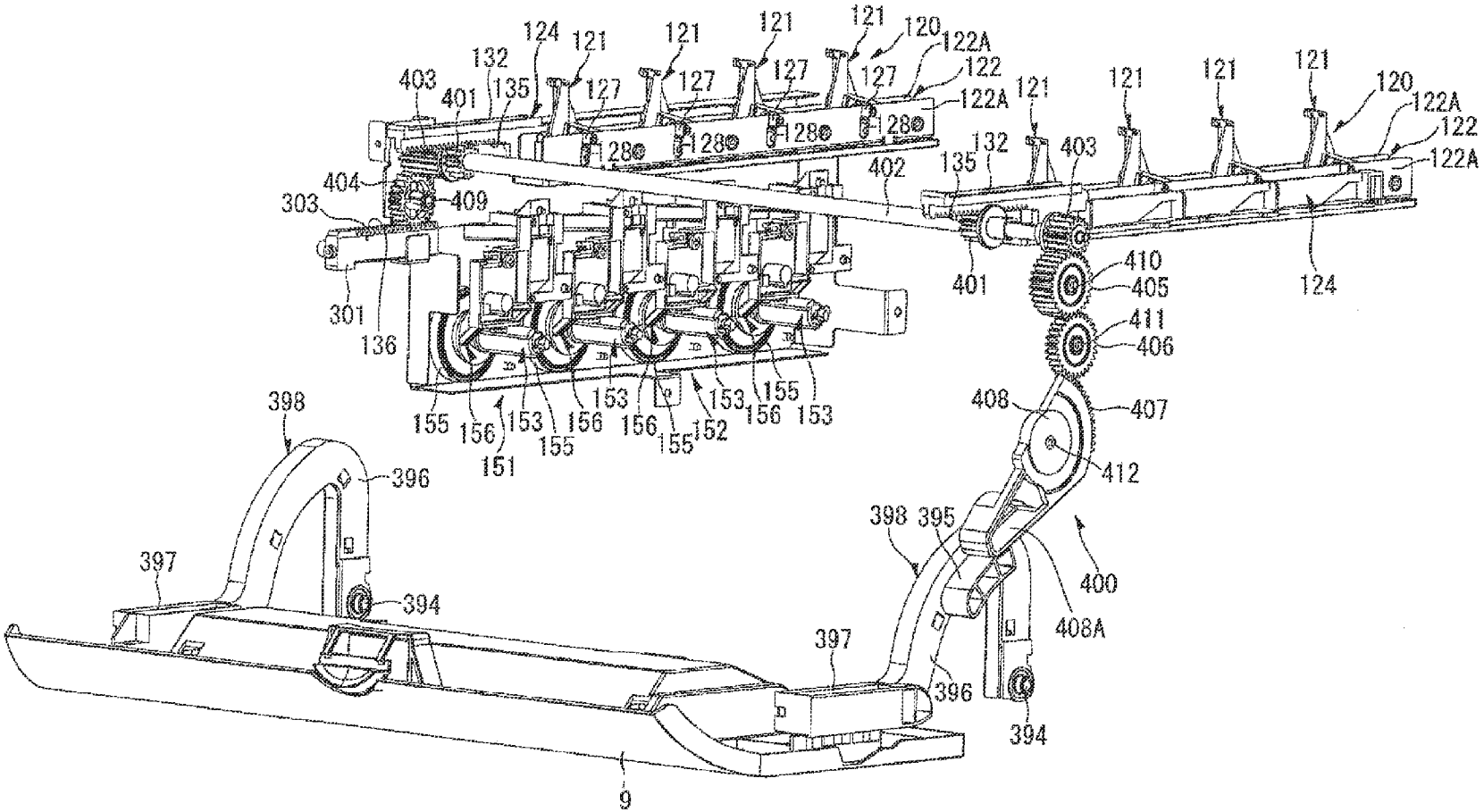
FIG. 26 is a perspective view of the pressing mechanisms, the driving force transmitting unit, and an interlocking mechanism with a front cover being open, as viewed from the right front.

As shown in FIG. 15, the holding member 122 is fixed to the upper surface of the base plate 24 of the scanner unit 20, and has a substantially C-shaped cross section with an opening on the top. The holding member 122 has left and right side plates 122A. As shown in FIG. 26, substantially U-shaped grooves 128 are formed in the left and right side plates 122A so as to extend downward from upper edges of the side plates 122A. Four of the grooves 128 are formed in either side plate 122A at intervals in the front-to-rear direction, such that the grooves 128 in the left side plate 122A oppose the grooves 128 in the right side plate 122A in the width direction.

Figure 17:
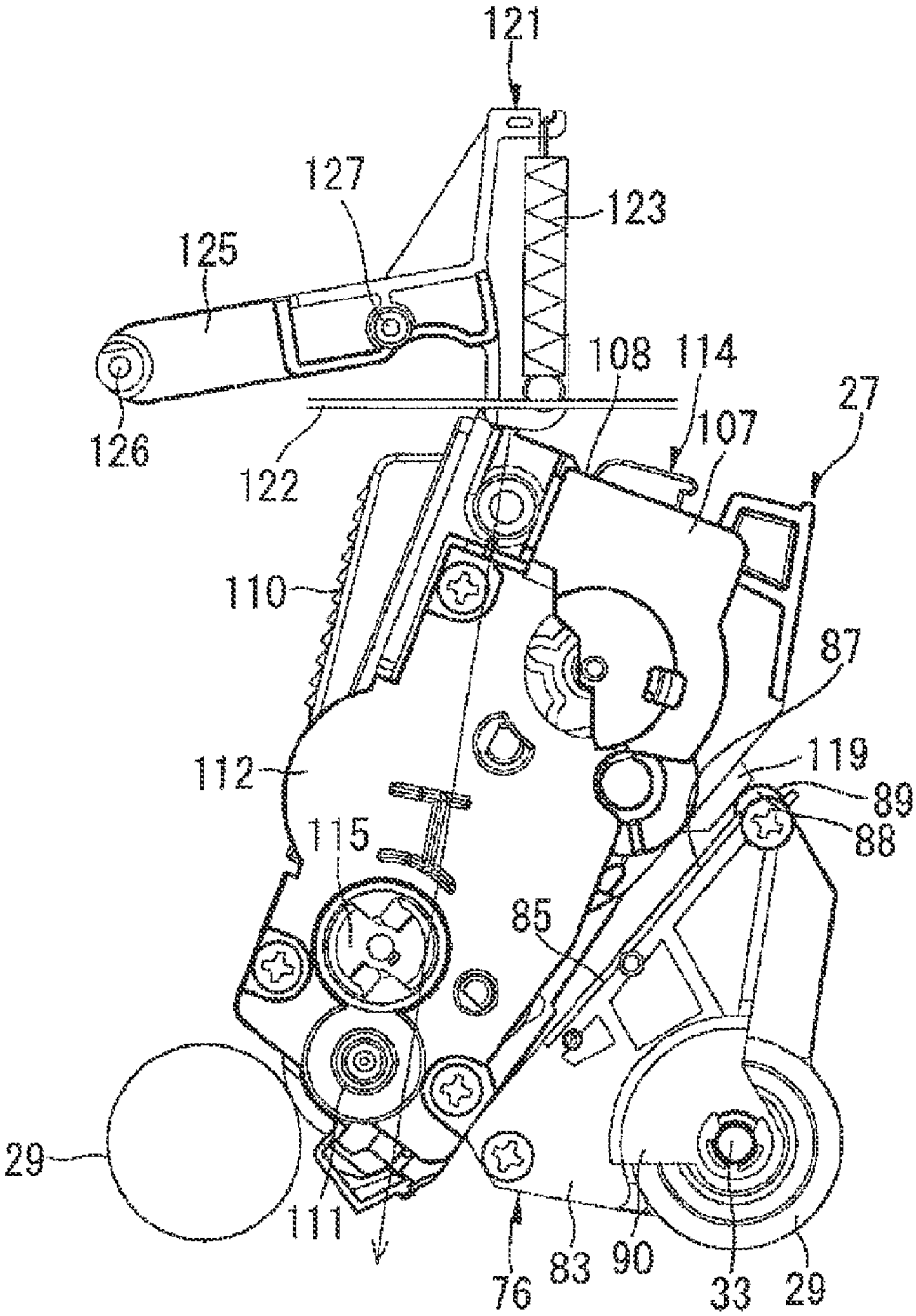
FIG. 17 is a side view of a pressing member pressing against a developing cartridge.
Figure 18:
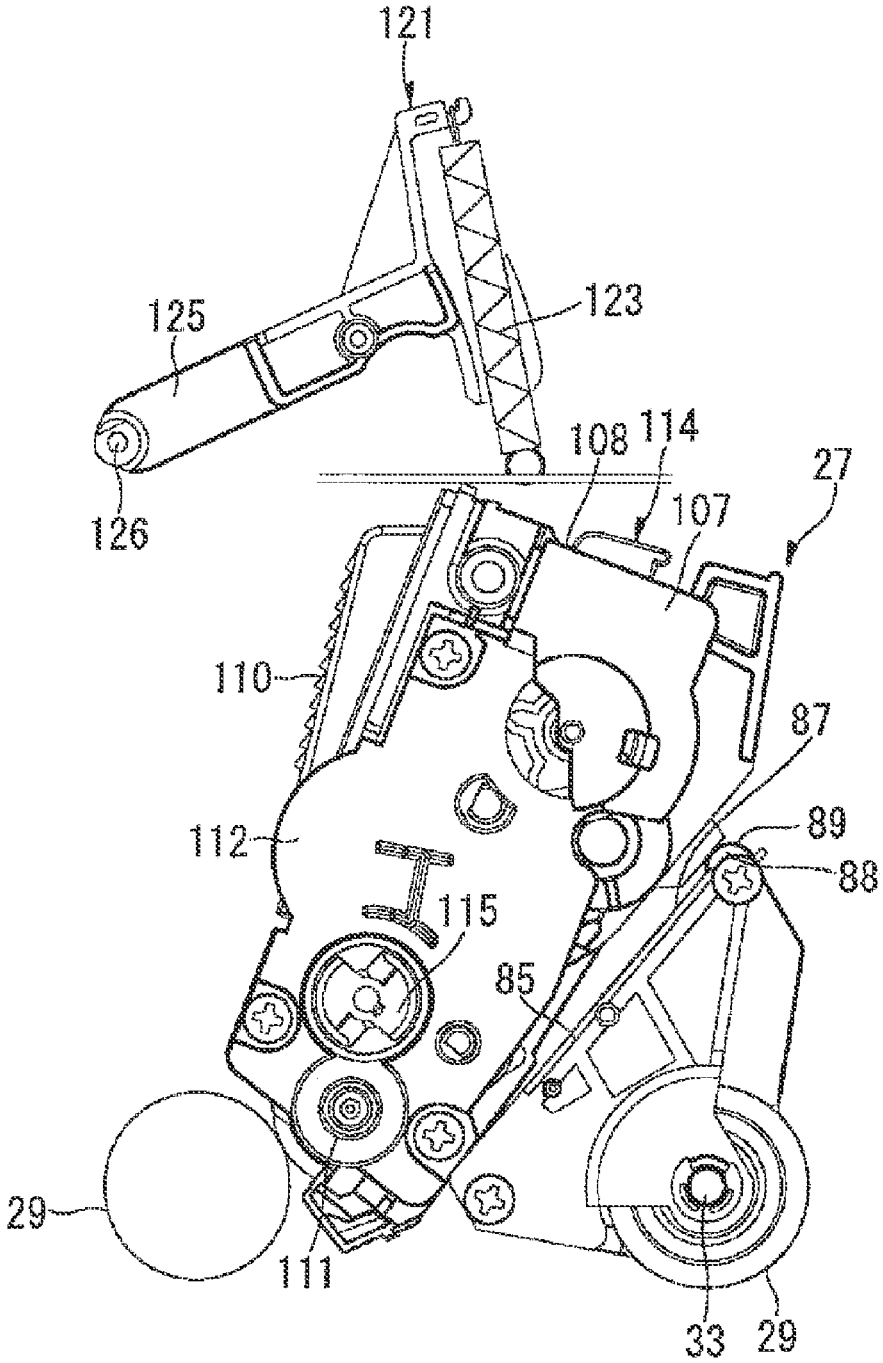
FIG. 18 is a side view of the pressing member separated from the developing cartridge.

The pressing members 121 are capable of moving between a pressing position shown in FIG. 17 to press the developing cartridge 27 and a separating position shown in FIG. 18 to separate from the developing cartridge 27. As shown in FIG. 15, the pressing members 121 are disposed between the left and right side plates 122A of the holding member 122. As shown in FIG. 17, each pressing member 121 has an elongated substantially rectangle shape in a side view. A supporting arm 125 extending backward is integrally formed with the pressing member 121 at the center of the pressing member 121 in the longitudinal direction (vertical direction). A rear end of the supporting arm 125 is pivotably supported on a supporting shaft 126 stretched between the left and right side plates 122A such that the supporting arm 125 is pivotable about the supporting shaft 126. Furthermore, each holding member 122 is integrally formed with a guide shaft 127 extending in the width direction at the center in the longitudinal direction. As shown in FIG. 26, both ends of the guide shaft 127 are fitted into the grooves 128 formed in the left and right side plates 122A.

The coil springs 123 urge the pressing members 121 toward the pressing positions. As shown in FIG. 17, one end of the coil spring 123 is locked at an upper end of the pressing member 121, and the other end is locked at the holding member 122. A center line of the coil spring 123 substantially aligns to that of the pressing member 121.

The pressing member direct-acting cam 124 is for moving the pressing mechanisms 120 in association with each other. As shown in FIG. 14, the pressing member direct-acting cam 124 is disposed on the outer side of the holding member 122 in the width direction so as to be linearly movable in the front-to-rear direction. As shown in FIGS. 14 to 16, the pressing member direct-acting cam 124 includes a base plate 129, a vertical plate 130, four cam parts 131, and a gear part 132, all formed integrally with one another. The base plate 129 extends in the front-to-rear direction along the upper surface of the base plate 24 of the scanner unit 20. The vertical plate 130 erects upward from the base plate 129 and extends in the front-to-rear direction. Each of the cam parts 131 has a substantially triangle plate shape.

The cam parts 131 protrude upward from the base plate 129 on the inner side of the vertical plate 130 in the width direction. The four cam parts 131 are provided to correspond to the four guide shafts 127 of the corresponding pressing member 121, and are disposed at fixed intervals in the front-to-rear direction. As shown in FIG. 14, each cam part 131 has an inclined surface 133 that inclines upward toward the rear, and a flat surface 134 extending from the rear edge of the inclined surface 133 in parallel with the base plate 129.

The gear part 132 is fixed to an upper end of the vertical plate 130 and extends forward from the vertical plate 130. The gear part 132 is shaped like a substantially elongated rectangle in a plan view. As shown in FIG. 26, a rack gear 135 is formed on a lower surface of the gear part 132.

The base plate 129 opposes the guide shafts 127 of the pressing members 121 in the vertical direction. When the pressing member direct-acting cam 124 is moved to a rearmost position shown in FIG. 27, as shown in FIG. 17, due to an urging force of the coil spring 123, a lower end of each pressing member 121 protrudes below the base plate 24 through an opening (not shown) formed in the holding member 122 and an opening (not shown) in the base plate 24 of the scanner unit 20, and comes into contact with an upper end of either side wall 107 of the corresponding developing cartridge 27, thereby pressing the developing cartridge 27 downward. Thus, the developing roller 39 of the developing cartridge 27 is pressed against the corresponding photosensitive drum 29. At this time, since the pressing force of the pressing member 121 pressing the developing cartridge 27 is oriented downward and contains a force component of the projecting members 119 of the developing cartridge 27 pressing against the supporting members 88 or 96, the developing cartridge 27 is positioned with respect to the corresponding drum sub-unit 28 firmly.

When the pressing member direct-acting cam 124 is moved forward as shown in FIG. 26 from this state, the guide shafts 127 (FIG. 14) of the pressing members 121 move rearward relative to the cam parts 131 so as to slide on the inclined surfaces 133 of the cam parts 131 toward the flat surfaces 134. As a result, the guide shafts 127 are lifted, and as shown in FIG. 18, the supporting arms 125 pivot upward, thereby moving the pressing members 121 from the pressing positions shown in FIG. 17 to the separating positions shown in FIG. 18. Thus, pressing of the pressing members 121 against the developing cartridges 27 is released at once.

Figure 29:
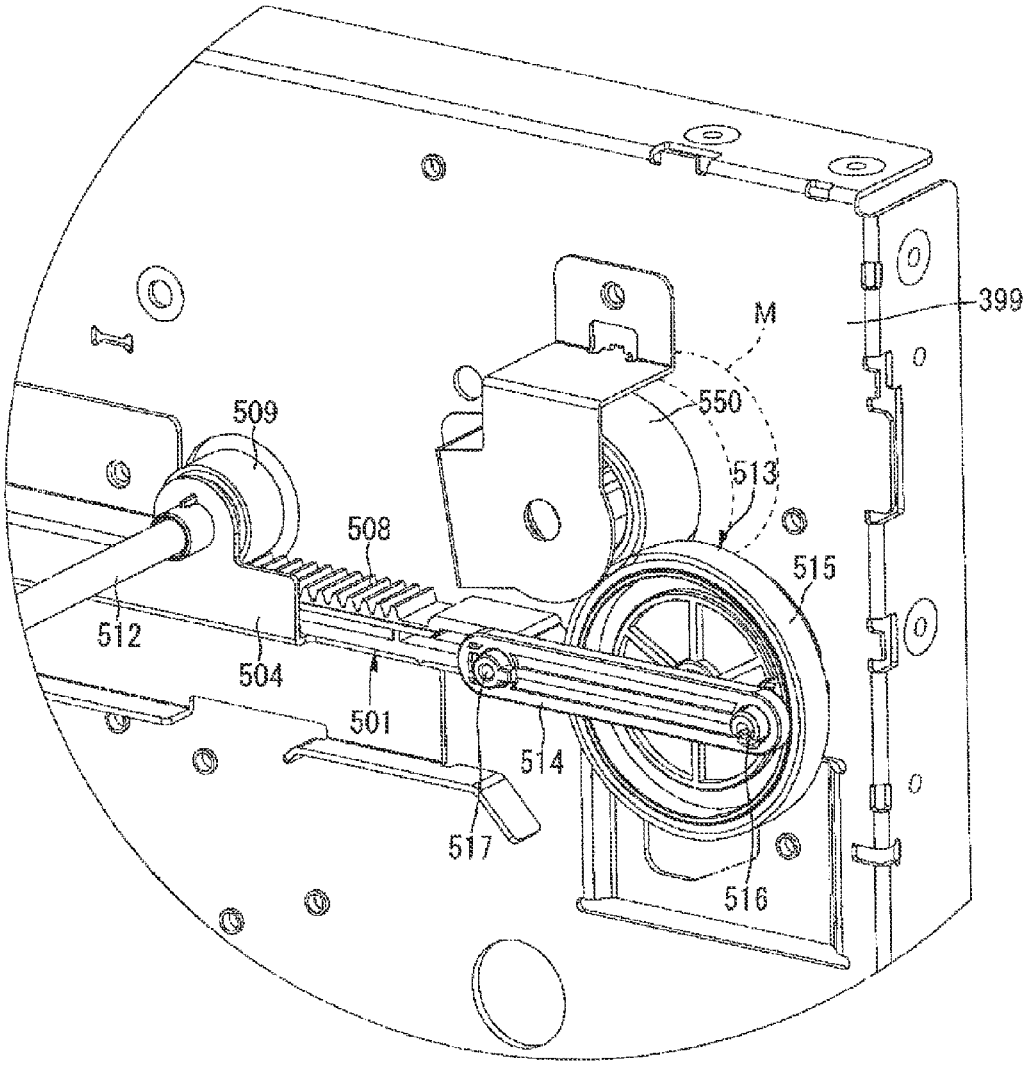
FIG. 29 is a perspective partial view of the contact/separation mechanism of FIG. 28.

The laser printer 1 further includes a pair of side plates 399 shown in FIG. 29 (only left side plate 399 is shown in FIG. 29) and a driving force transmitting unit 151 shown in FIG. 19. The pair of side plates 399 are disposed in the main casing 2 one on either side of the process part 21 (FIG. 1) so as to oppose each other in the width direction. The driving force transmitting unit 151 serves to transmit a driving force to the developing cartridges 27 and is disposed on an outer side surface of the left side plate 399.

The driving force transmitting unit 151 includes a holder 152 which is attached to the outer side surface of the left side plate 399. The driving force transmitting unit 151 further includes four developing driving gears 155, the four coupling male members 153, four springs 191 (FIG. 20), the four motors 154, four control members 156, four supporting members 307, a coupling member (not shown), and a lever (not shown), which are all held by the holder 152.

The holder 152 is made of a metal plate and has a main plate 221, a front plate 222, a front fixing part 223, a rear plate 224, three rear fixing parts 225, an upper plate 226, a lower plate 227, and a lower fixing part 228, all integrally formed with one another.

The main plate 221 extends in the front-to-rear direction and has a substantially rectangular shape in a side view. The front plate 222 extends to the right from a front edge at an upper part of the main plate 221. The front fixing part 223 extends forward from the right edge of the front plate 222. The rear plate 224 extends to the right from a rear edge of the main plate 221, and has a substantial C-shape in a front view. The rear fixing parts 225 are disposed at intervals in the vertical direction and extend rearward from a right edge of the rear plate 224. The upper plate 226 extends to the right from an upper edge of the main plate 221. The lower plate 227 extends to the right from a lower edge of the main plate 221. The lower fixing part 228 has an L-shaped cross section and extends rightward from the center of the lower plate 227 in the front-to-rear direction, and bends downward.

The holder 152 is attached to the left side plate 399 by bringing the front fixing part 223, the rear fixing parts 225, and the lower fixing part 228 into contact with the outer side surface of the left side plate 399, inserting screws into screw holes 229 formed in the front fixing part 223, the rear fixing parts 225, and the lower fixing part 228, and screwing the screws in the left side plate 399.

Each developing driving gear 155 is disposed on a right side surface of the main plate 221 of the holder 152 so as to be freely rotatable about a rotational axis extending in the width direction. Each developing driving gear 155 is shaped like a disk, and as shown in FIG. 25(*a*), has a gear main member 193 having many outer gear teeth on its outer periphery and a substantially cylindrical coupling boss 194 which is coupled to the center of the gear main member 193 and extends in the width direction.

The coupling male members 153 are aligned in a line in the front-to-rear direction. Each coupling male member 153 has a main body 172, a collar part 171, and connecting part 195, all formed integrally with one another. The coupling boss 194 of the developing driving gear 155 is inserted into the main body 172 so as to be unrotatable but slidable in the width direction (the rotational axis direction of the driving gear 155) with respect to the main body 172. The collar part 171 extends outward in the radial direction from a base end of the main body 172 on the developing driving gear 155 side. The connecting part 195 is provided at a front end of the main body 172 on the opposite side from the collar part 171.

Figure 25A:
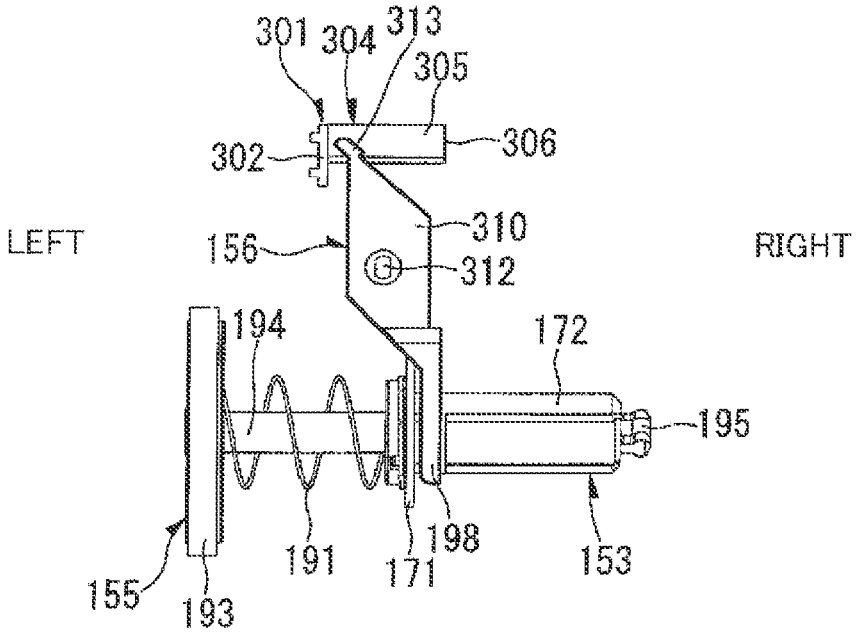
FIG. 25(*a*) is a front view of a control member at a coupling position.
Figure 25B:
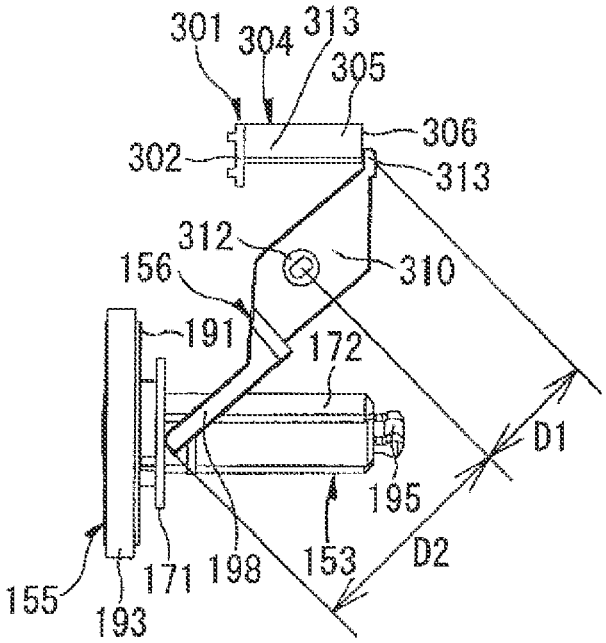

Each coupling male member 153 is movable between a coupling position shown in FIG. 25(*a*) and a releasing position shown in FIG. 25(*b*) with respect to the driving gear 155. In the state where the drum unit 26 with the developing cartridges 27 is mounted to the main casing 2, the connecting part 195 of each coupling male member 153 at the coupling position is coupled to the coupling female member 113 of the corresponding developing cartridge 27 (FIG. 5). However, when the coupling male member 153 is moved from the coupling position to the releasing position, the connecting part 195 retracts to the outer side (left side) of the left side plate 399 in the width direction, and coupling between the coupling female member 113 and the corresponding developing cartridge 27 is released.

The springs 191 are compression springs and wound around the coupling bosses 194 of the corresponding developing driving gears 155. Each spring 191 is connected to the gear main member 193 of the corresponding developing driving gear 155 at one end and connected to the main body 172 of the corresponding coupling male member 153 at the other end, thereby urging the coupling male member 153 toward the coupling position.

Figure 22:
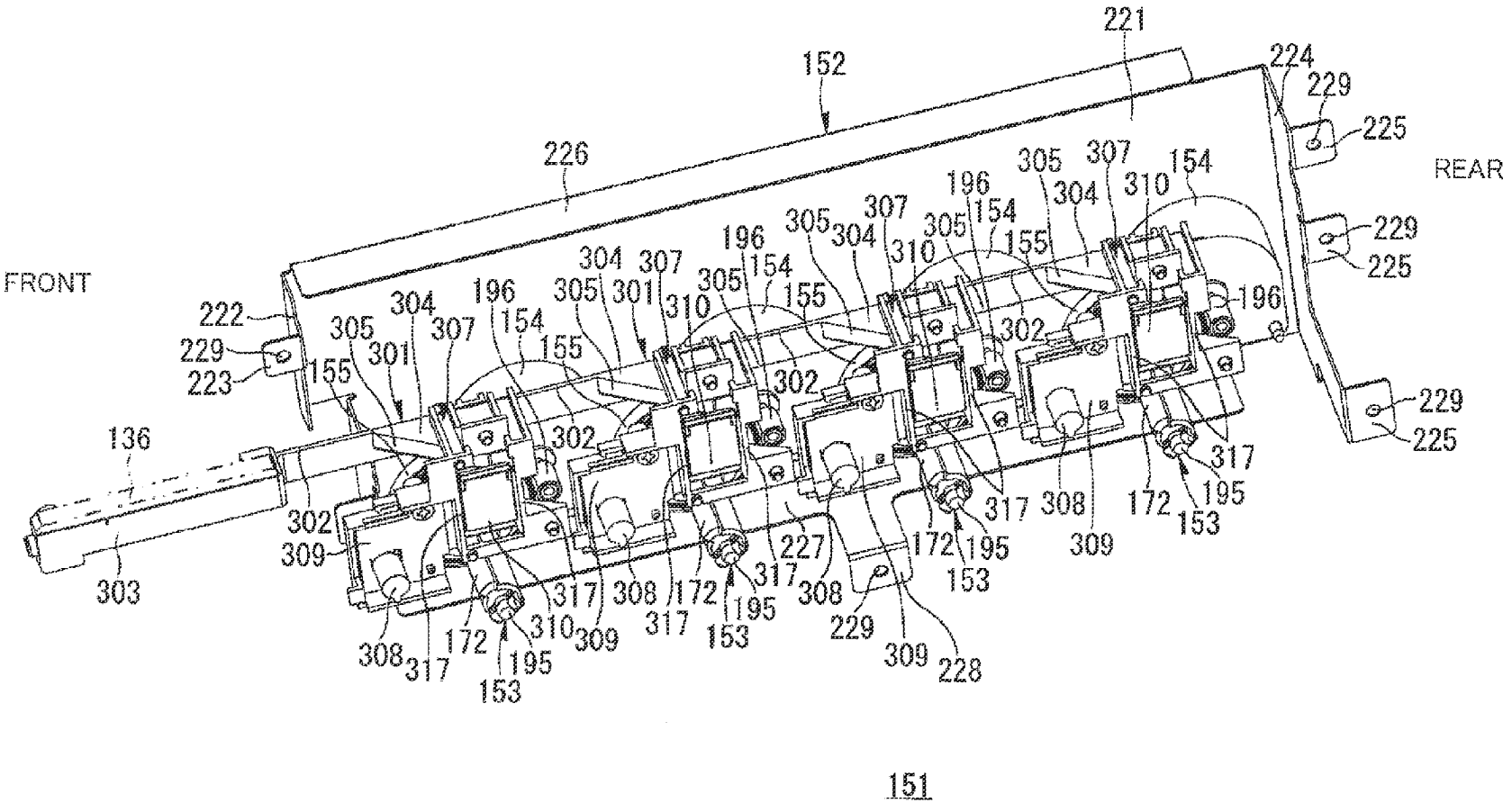
FIG. 22 is a perspective view of the driving force transmitting unit in FIG. 19 at a foremost position as viewed from the right front.

As shown in FIG. 22, the motors 154 are disposed on a right side surface of the main plate 226 of the holder 152 and to the rear of the corresponding developing driving gears 155. Each of the motors 154 has a driving shaft which protrudes toward the inner side in the width direction, and an input gear 196 engaging with the outer teeth of the corresponding developing driving gear 155 is fixed to a tip end of the driving shaft.

Figure 23:
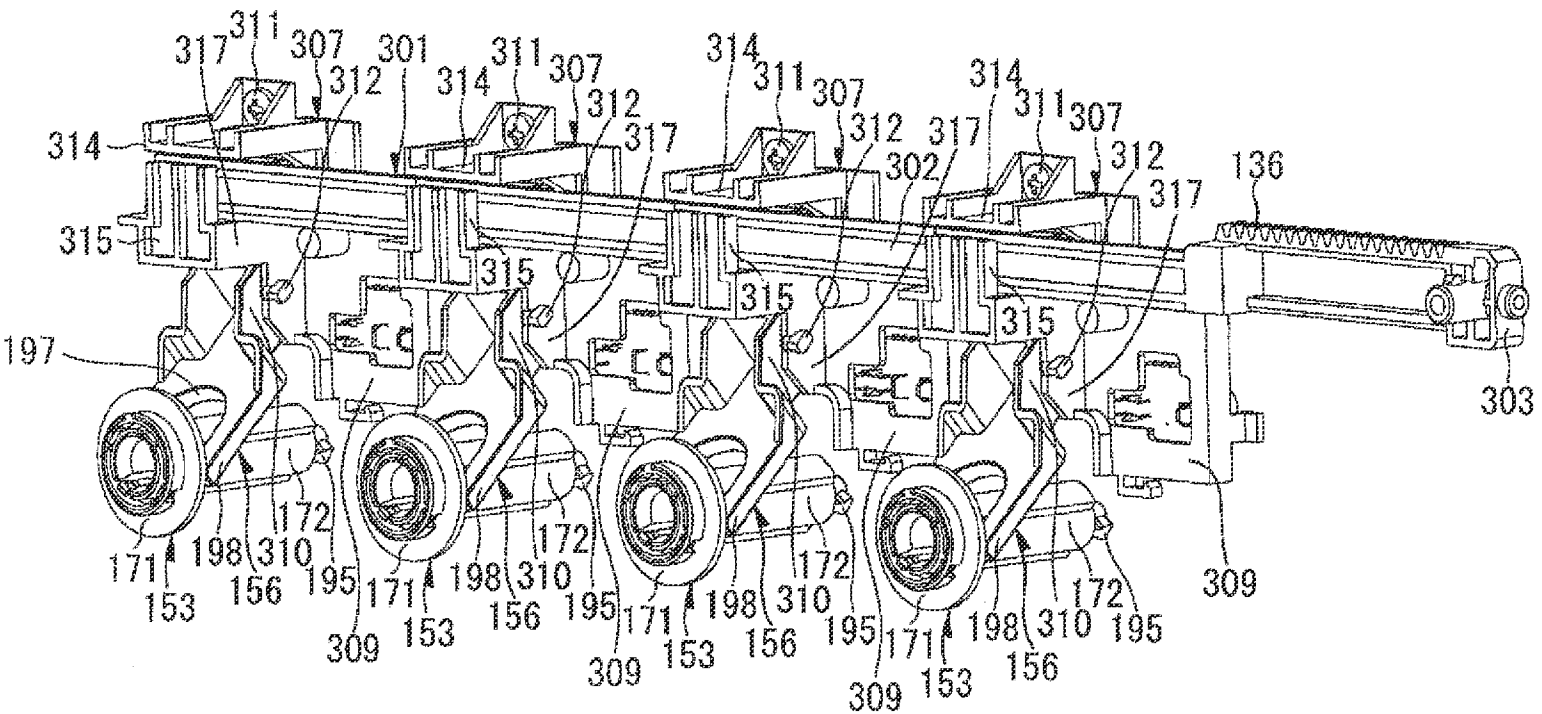
FIG. 23 a perspective view of the driving force transmitting unit in FIG. 22 with the holder, the motors, and the developing driving gears being omitted, as viewed from the left front.

The control members 156 (FIG. 23) correspond to the coupling male members 153, and are disposed on the inner side (right side) of the corresponding developing driving gears 155 so as to be in opposition with the corresponding developing driving gears 155 in the width direction. As shown in FIGS. 23 and 25(*a*), each control member 156 has a main unit 310, a pair of pivot shafts 312, a cam surface contact part 313, and a pair of engaging parts 198, all formed integrally with one another.

The main unit 310 has a parallelogram shape in a front view. The pivot shafts 312 protrude in the front-to-rear direction, one from the center of either front or rear surface of the main unit 310. The cam surface contact part 313 is formed on an upper end of the main unit 310. The engaging parts 198 extend from a lower end of the main unit 310. A substantially semicircular cutout part 197 is formed between the pair of engaging parts 198. The main body 172 of the corresponding coupling male member 153 is inserted into the cutout part 197.

Each control member 156 is swingably supported by the corresponding supporting member 307 shown in FIG. 19. Specifically, the four supporting members 307 are provided to correspond to the control members 156. The supporting members 307 are aligned in a line at fixed intervals in the front-to-rear direction, and are attached to the outer surface of the left side plate 399 opposed to the holder 152 by a plurality of screws 311. Each supporting member 307 has a pair of front and rear side plates 317 opposed to each other in the front-to-rear direction. The pivot shaft 312 of the control member 156 is rotatably supported on the pair of side plates 317 of the corresponding supporting member 307, such that the control member 156 is swingably supported between the pair of side plates 317.

As shown in FIG. 19, each supporting member 307 is integrally formed with a sensor disposing part 309 extending forward from the front side plate 317. The light receiving element 308 of the optical sensor 173 is disposed on the corresponding sensor disposing part 309.

Figure 21:
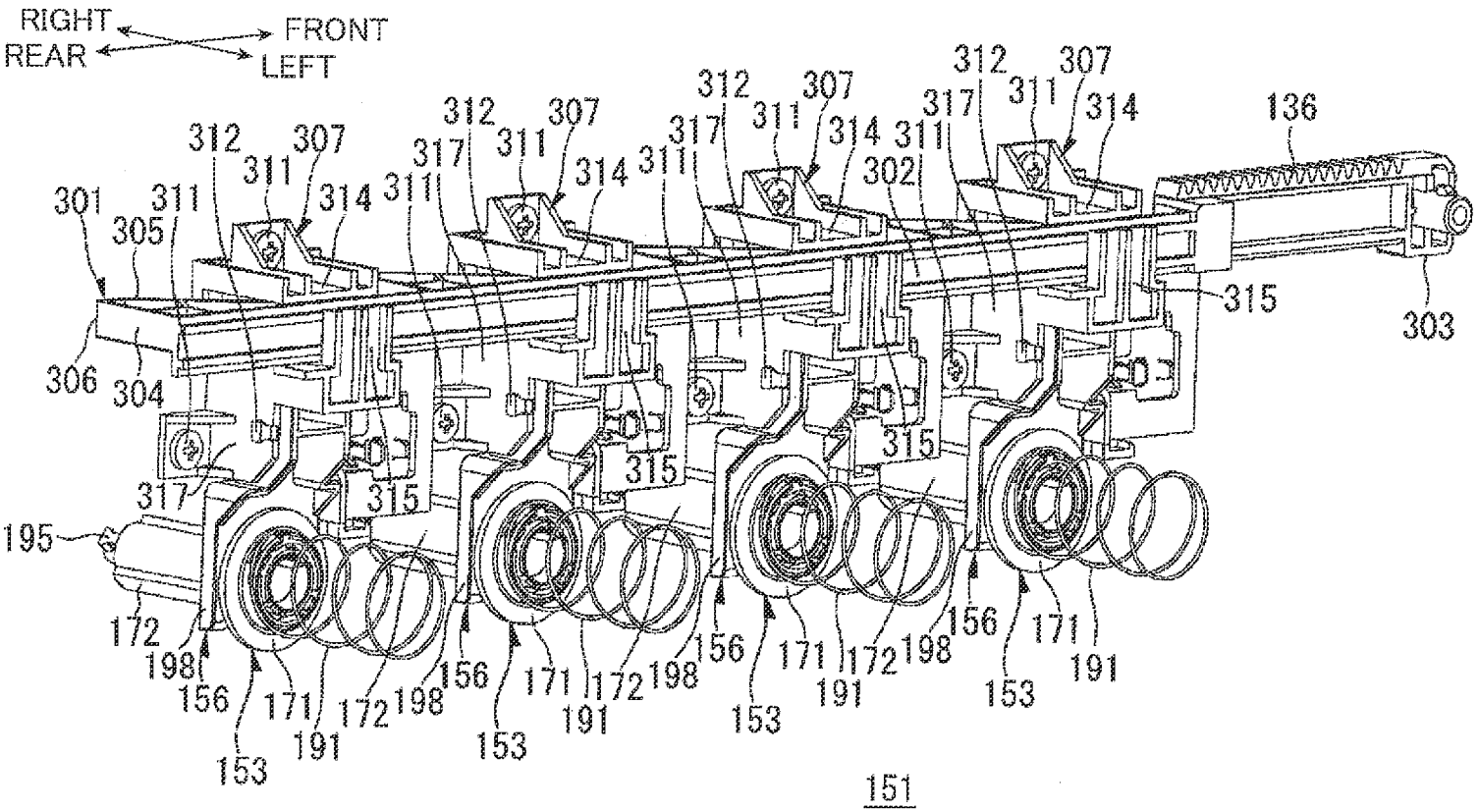
FIG. 21 is a perspective view of the driving force transmitting unit in FIG. 20 with the holder, the motors, and developing driving gears being omitted, as viewed from the left rear.

As shown in FIG. 21, the driving force transmitting unit 151 further includes a drive transmitting member direct-acting cam 301.

Figure 20:
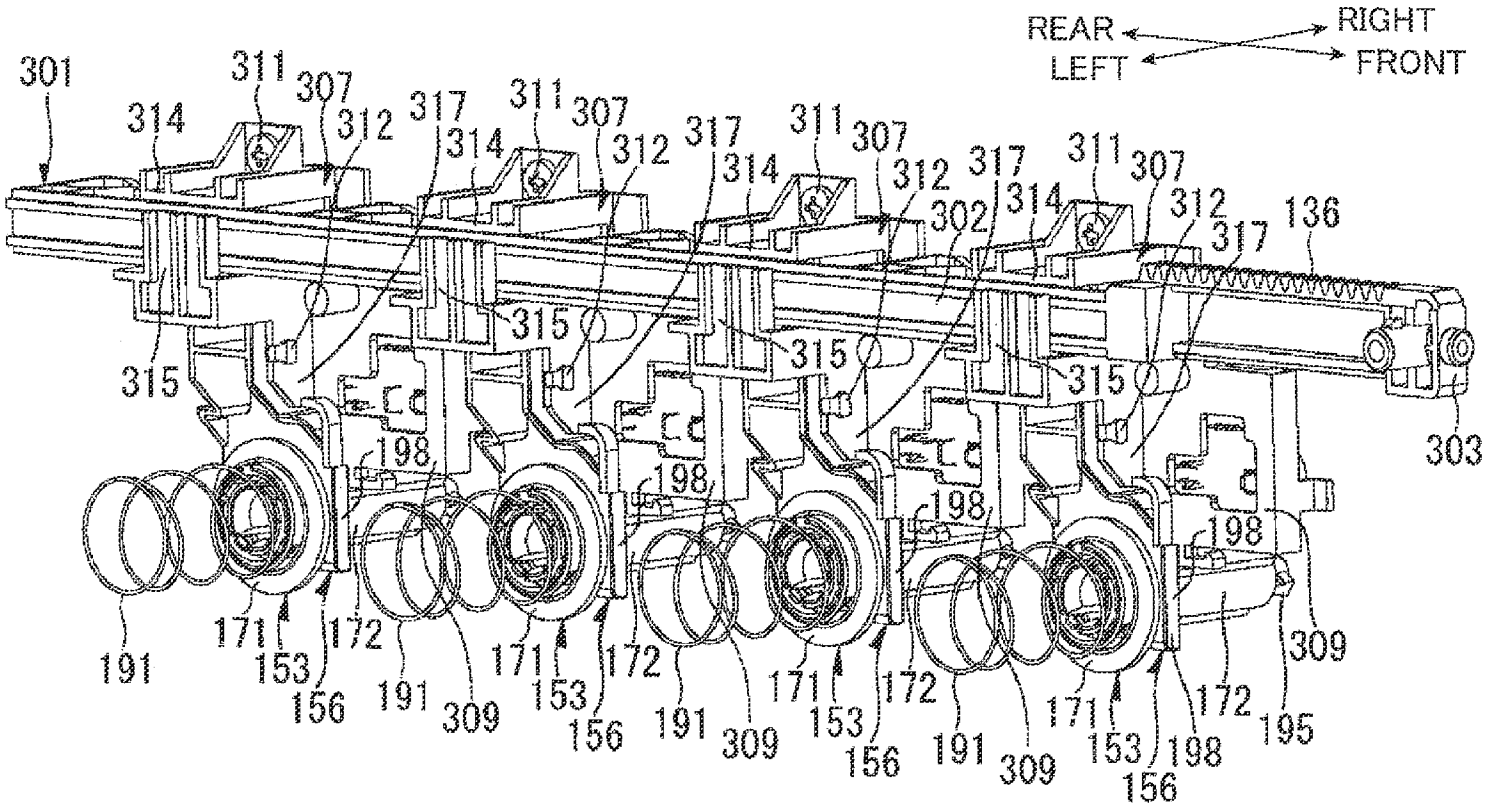
FIG. 20 is a perspective view of the driving force transmitting unit in FIG. 19 with a holder, motors, and developing driving gears being omitted, as viewed from the left front.
Figure 24:
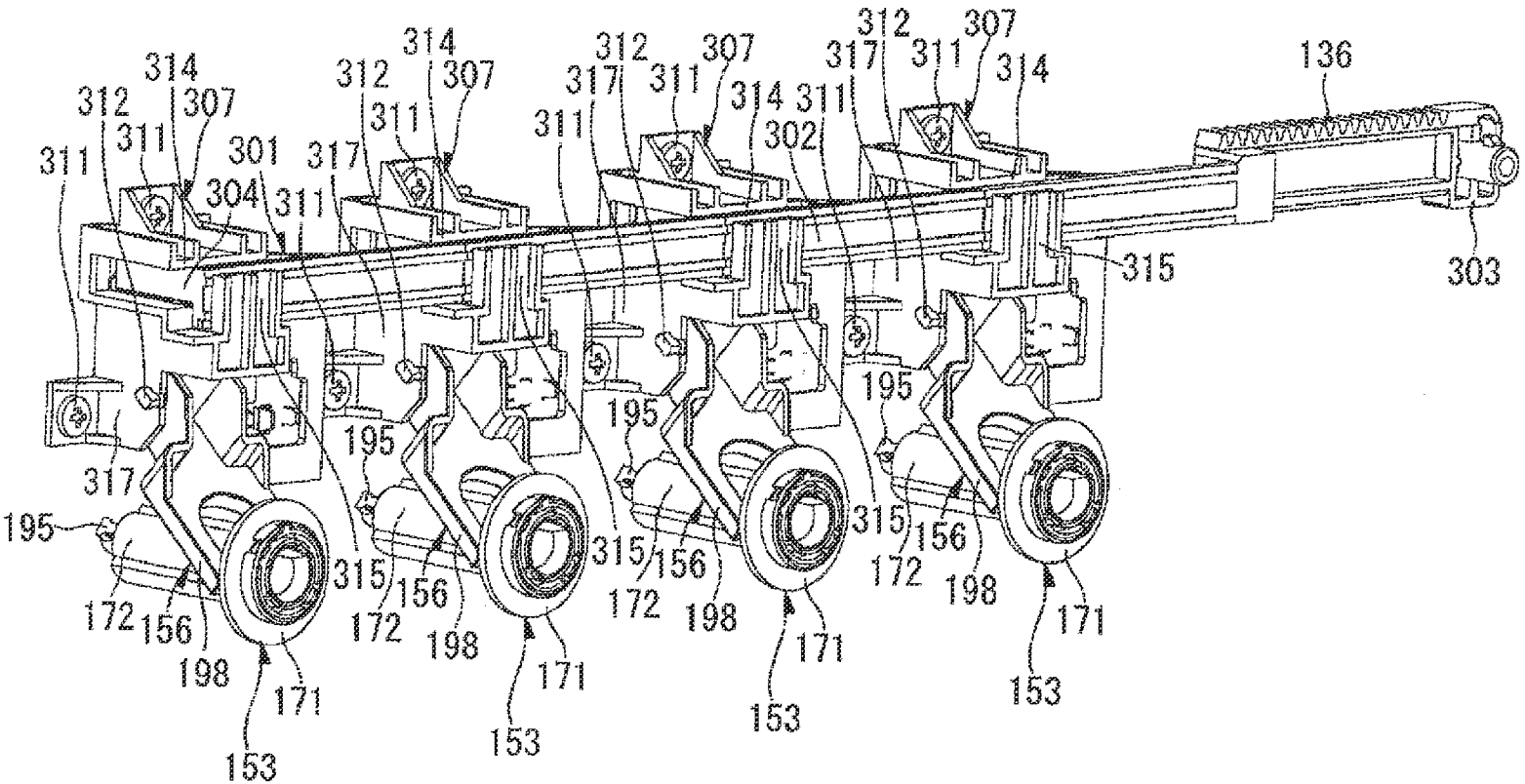
FIG. 24 is a perspective view of the driving force transmitting unit in FIG. 22 with the holder, the motors, and the developing driving gears being omitted, as viewed from the left rear.

The drive transmitting member direct-acting cam 301 is supported by the supporting members 307 so as to be linearly movable in the front-to-rear direction (direction substantially parallel to the pivot shafts 312 of the control members 156) between a rearmost position shown in FIGS. 19 to 21 and a foremost position shown in FIGS. 22 to 24. The drive transmitting member direct-acting cam 301 has a lever main part 302, a gear part 303, and four cam parts 304, all formed integrally with one another. The lever main part 302 has an elongated rectangular plate shape which is longer in the front-to-rear direction. The gear part 303 is connected to a front end of the lever main part 302. A rack gear 136 is formed on an upper surface of the gear part 303. The cam parts 304 protrude from a surface (right side surface) of the lever main part 302 opposed to the left side plate 399. Each of the cam parts 304 has a substantial triangle plate shape.

As shown in FIG. 19, the four cam parts 304 correspond to the four control members 156 and are disposed at fixed intervals in the front-to-rear direction. Each cam part 304 has an inclined surface 305 inclined rightward forward the rear and a flat surface 306 extending in parallel with the right side surface of the lever main part 302 from a rear edge of the inclined surface 305.

When the drive transmitting member direct-acting cam 301 is located at the rearmost position as shown in FIG. 19, the control members 156 locate to the front of the corresponding cam parts 304 and oppose the right side surface of the lever main part 302. Also, as shown in FIG. 25(*a*), the coupling male members 153 are located at the coupling positions due to elastic force of the springs 191.

In this state, the pair of engaging parts 198 is opposed to the collar parts 171 of the corresponding coupling male members 153 in the moving direction of the coupling male members 153 and separate from the collar parts 171. Also, the coupling male members 153 at the coupling positions are coupled to the corresponding coupling female members 113 (FIG. 5) in the state where the drum unit 26 with the developing cartridges 27 are attached to the main casing 2.

When the drive transmitting member direct-acting cam 301 is moved forward from this state, the cam surface contact parts 313 (FIG. 25(*a*)) of the control members 156 relatively move rearward on the inclined surfaces 305 of the corresponding cam parts 304. In association with this movement, the control members 156 swing about the pivot shafts 312, and the tip ends of the engaging parts 198 of the control members 156 come into contact with the collar parts 171 of the coupling male members 153 at centers in the vertical direction. The engaging parts 198 press the collar parts 171 toward the releasing positions against the elastic force of the springs 191, thereby moving the coupling male members 153 from the coupling positions to the releasing positions shown in FIG. 25(*b*) at once. In this manner, the coupling between the coupling female members 113 of the developing cartridges 27 and the coupling male members 153 are released at once.

Here, as shown in FIG. 20, the supporting members 307 have respective upper guide parts 314 and side guide parts 315. The upper guide parts 314 prevent the drive transmitting member direct-acting cam 301 from rising upward and guide the movement of the drive transmitting member direct-acting cam 301 in the front-to-rear direction. The side guide parts 315 prevent the drive transmitting member direct-acting cam 301 from moving to the outer side in the width direction (the holder 152 side) due to a counter force of the springs 191 and guide the movement of the drive transmitting member direct-acting cam 301 in the front-to-rear direction in cooperation with the upper guide parts 314.

As shown in FIG. 26, the laser printer 1 further includes an interlocking mechanism 400 for moving the pressing member direct-acting cams 124 and the drive transmitting member direct-acting cam 301 in conjunction with opening/closing of the front cover 9.

As described above, the front cover 9 is supported by the pair of left and right cover supporting members 398 so as to be capable of open and close.

Figure 27:
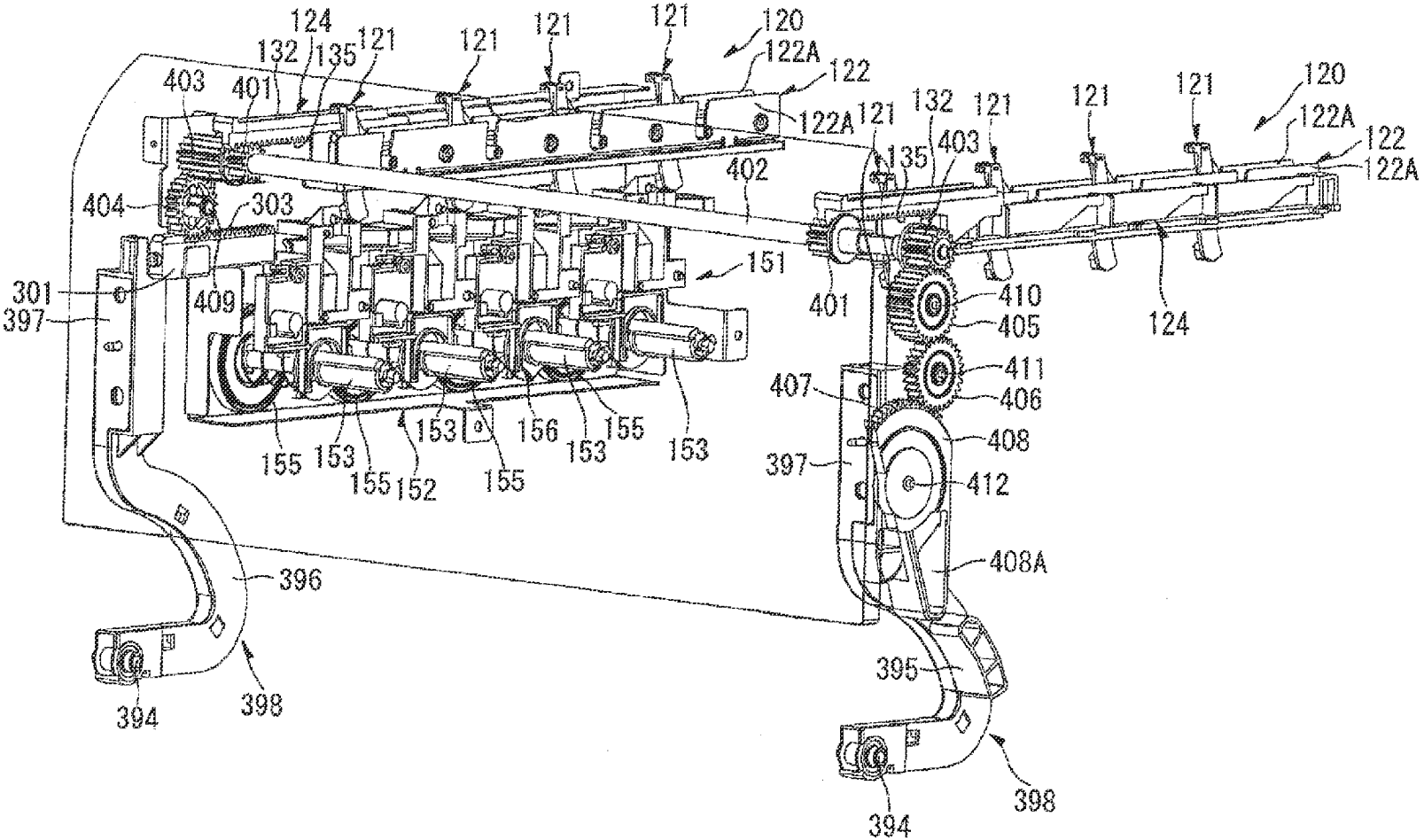
FIG. 27 is a perspective view of the pressing mechanisms, the driving force transmitting unit, and the interlocking mechanism with a front cover being closed open, as viewed from the right front.

As shown in FIG. 26, each of the cover supporting members 398 includes a cover fixing member 397, a bending member 396 formed integrally with the cover fixing member 397, and a supporting shaft 394. The fixing member 397 is fixed to an edge of the front cover 9 in the width direction, and the bending member 396 is connected to a lower edge of the cover fixing member 397. The bending member 396 bends into a substantially U-shape in a side view. As shown in FIG. 27, when the front cover 9 is closed, a bending part of the bending member 396 protrudes rearward. An operating part 395 is integrally formed on an outer surface of the bending member 396 of the right cover supporting member 398 in the width direction. The operating part 395 extends toward the front cover 9 from a bending point of the bending member 396. The supporting shaft 394 is rotatably supported on the left and right side plates 399 in the main casing 2.

The interlocking mechanism 400 includes a pair of pressing member driving gears 401, a holding shaft 402, a pair of left and right transmitting gears 403, a joint movable gear 404, an intermediate gear 405, an input gear 406, a gear 407, and an operating gear part member 408. The pressing member driving gears 401 engage with the rack gears 135 of the corresponding pressing member direct-acting cams 124. The holding shaft 402 is rotatably supported on the left and right side plates 399 in the main casing 2. The pressing member driving gears 401 are attached to the holding shaft 402 so as not to be relatively rotatable. The left and right transmitting gears 403 are attached to left and right ends of the holding shaft 402 so as not to be relatively rotatable. The movable gear 404 is engaged with the left transmitting gear 403 and the rack gear 136 of the drive transmitting member direct-acting cam 301. The intermediate gear 405 is engaged with the right transmitting gear 403, and the input gear 406 is engaged with the intermediate gear 405. The operating gear part member 408 has a fan-shape in a side view. A gear 407 is formed on the periphery of the operating gear part member 408 and engaged with the input gear 406.

The joint movable gear 404 is rotatable about a shaft 409 that extends in the width direction and is rotatably supported on the left side plate 399. Also, the intermediate gear 405 and the input gear 406 are respectively rotatable about shafts 410 and 411, which extend in the width direction and are rotatably supported on the right side plate 399.

The operating gear part member 408 is rotatable about a shaft 412 that extends in the width direction and is supported on the right side plate 399.

When the front cover 9 is open as shown in FIG. 26, an end part 408A of the operating gear part member 408 on the opposite side from the gear 407 contacts an upper end of the operating part 395 of the right cover supporting member 398 from above, and the gear 407 engages with the input gear 406 at one end.

On the other hand, when the front cover 9 is closed as shown in FIG. 27, the end part 408A of the operating gear part member 408 opposes the upper end of the operating part 395 from the front, and the gear 407 engages with the input gear 406 at the other end.

With this configuration, when the front cover 9 is pivoted to be opened, the operating part 395 presses the end part 408A of the operating gear part member 408 forward, and the operating gear part member 408 rotates about the shaft 412 from the state in FIG. 27 in clockwise direction in FIG. 27. Thus, the input gear 406 rotates in counterclockwise direction in FIGS. 25 and 26. The rotation is transmitted to the right transmitting gear 403 through the intermediate gear 405. Accordingly, the holding shaft 402, the pressing member driving gears 401, and the left transmitting gear 403 together with the right transmitting gear 403 rotate in counterclockwise direction in FIGS. 26 and 27. As a result, the pressing member direct-acting cams 124 move forward, and as described above, pressing of the pressing members 121 against the developing cartridges 27 is released at once (FIG. 18). In association with the rotation of the left transmitting gear 403, the drive transmitting member direct-acting cam 301 moves forward and as described above, the coupling male members 153 move from the coupling positions to the releasing positions shown in FIG. 25(*b*) at once. Thus, the coupling between the coupling female members 113 of the developing cartridges 27 and the coupling male members 153 is released at once.

On the contrary, when the front cover 9 is pivoted to be closed, the operating part 395 presses the end part 408A of the operating gear part member 408 rearward, so that the operating gear part member 408 rotates about the shaft 412 in counterclockwise direction in FIGS. 26 and 27. Thus, the input gear 406 rotates in clockwise direction in FIGS. 26 and 27. This rotation is transmitted to the right transmitting gear 403 through the intermediate gear 405. The holding shaft 402, the pressing member driving gears 401, and the left transmitting gear 403 as well as the right transmitting gear 403 rotate in clockwise direction in FIGS. 26 and 27. As a result, the pressing member direct-acting cams 124 move rearward, and as described above, the developing cartridges 27 are pressed by the pressing members 121 at once (FIG. 17). Furthermore, in association with the rotation of the left transmitting gear 403, the drive transmitting member direct-acting cam 301 moves rearward, and as described above, the coupling male members 153 move from the releasing positions to the coupling positions at once. Thus, the coupling female members 113 of the developing cartridges 27 are coupled to the corresponding coupling male members 153 at once (FIG. 25(*a*)).

Figure 28:
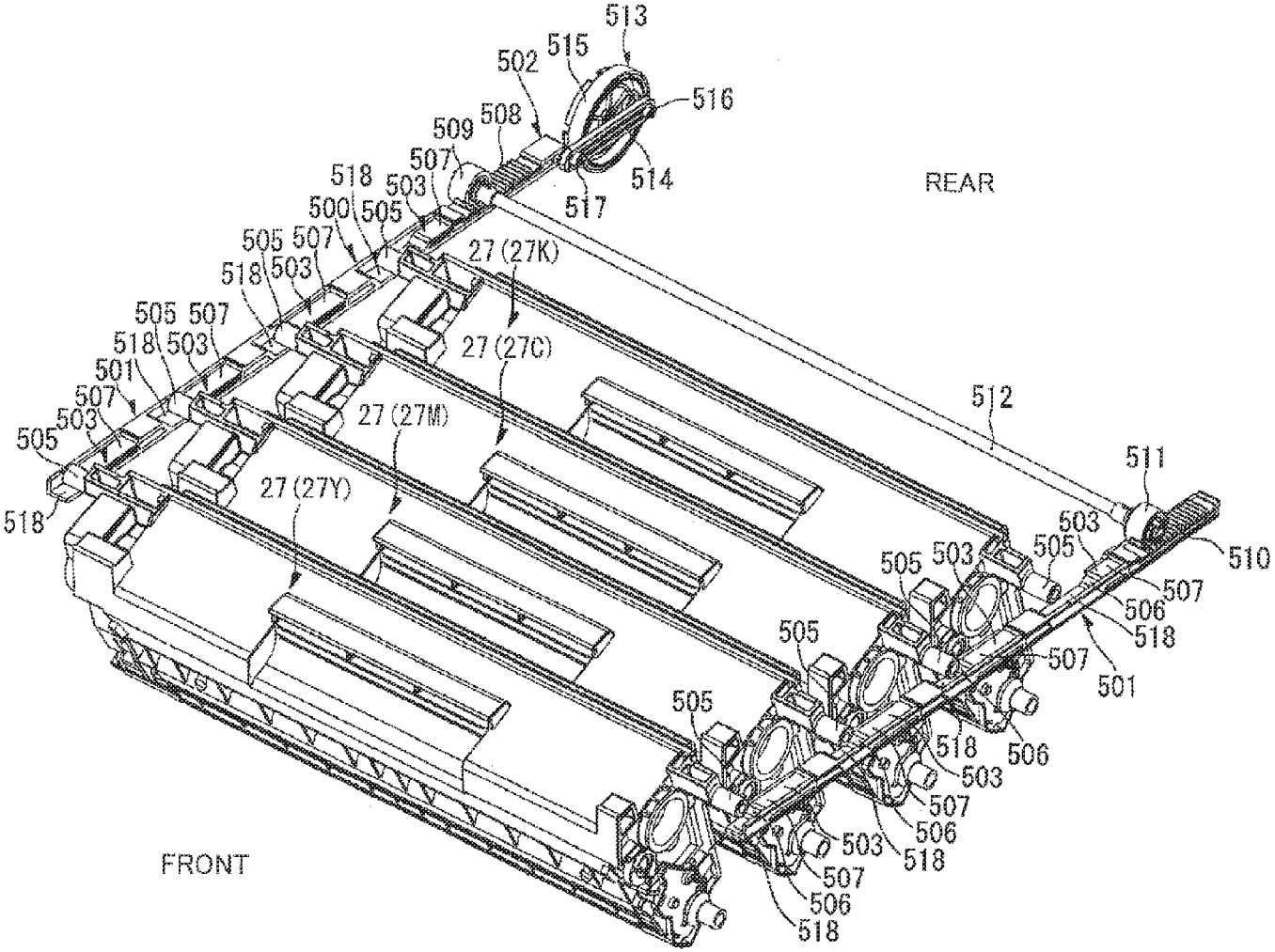
FIG. 28 is a perspective view of a contact/separation mechanism of the laser printer in FIG. 1, as viewed from the upper right front.

As shown in FIG. 28, the laser printer 1 further includes a contact/separation mechanism 500 for linearly moving the developing cartridges 27 between contact positions at which the developing rollers 39 contact with the corresponding photosensitive drums 29 and separating positions at which the developing rollers 39 separate from the corresponding photosensitive drums 29.

The contact/separation mechanism 500 includes a pair of contact/separation members 501 and a synchronous moving mechanism 502. The contact/separation members 501 are disposed one on either side of the four developing cartridges 27 in opposition with each other in the width direction. Each of the contact/separation members 501 is in a plate shape elongated in the front-to-rear direction and linearly movable in the front-to-rear direction. The synchronous moving mechanism 502 is for linearly moving the contact/separation members 501 in association with each other.

As shown in FIG. 29, contact/separation member holders 504 (only one is shown in FIG. 29) are provided one on an inner surface of either side plate 399. The contact/separation member holders 504 have a substantially L-shaped cross section and extend in the front-to-rear direction. Each of the contact/separation members 501 is slidably held by the corresponding contact/separation member holder 504, and as shown in FIG. 28, opposes protruding parts 505 protruding outward in the width direction from the upper end of either one of the side walls 107 of each developing cartridge 27 from below.

Figure 31:
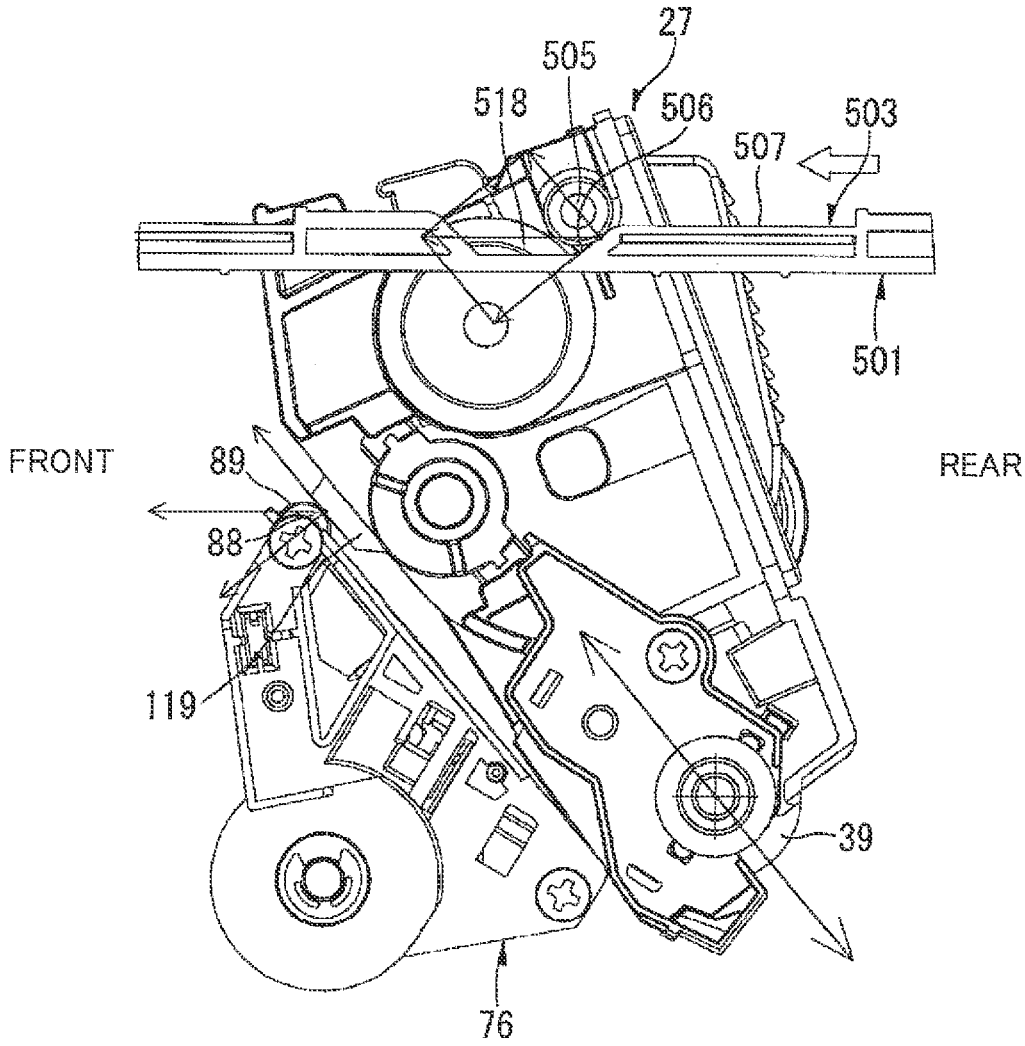
FIG. 31 is a right side view of a representative developing cartridge showing directions of force applied to components.

Four cam parts 503 are provided on an upper surface of each contact/separation member 501 so as to correspond to the four protruding parts 505. Each cam part 503 has a substantially trapezoidal shape in a side view, and has a sliding surface 506 inclined upward toward the rear and a flat separating surface 507 extending in parallel with the upper surface of the contact/separation member 501 from a rear edge of the sliding surface 506. As shown in FIG. 31, a contact surface 518 is provided on the upper surface of the contact/separation member 501 and to the rear of each cam part 503.

Figures 30A, 30B, 30C:
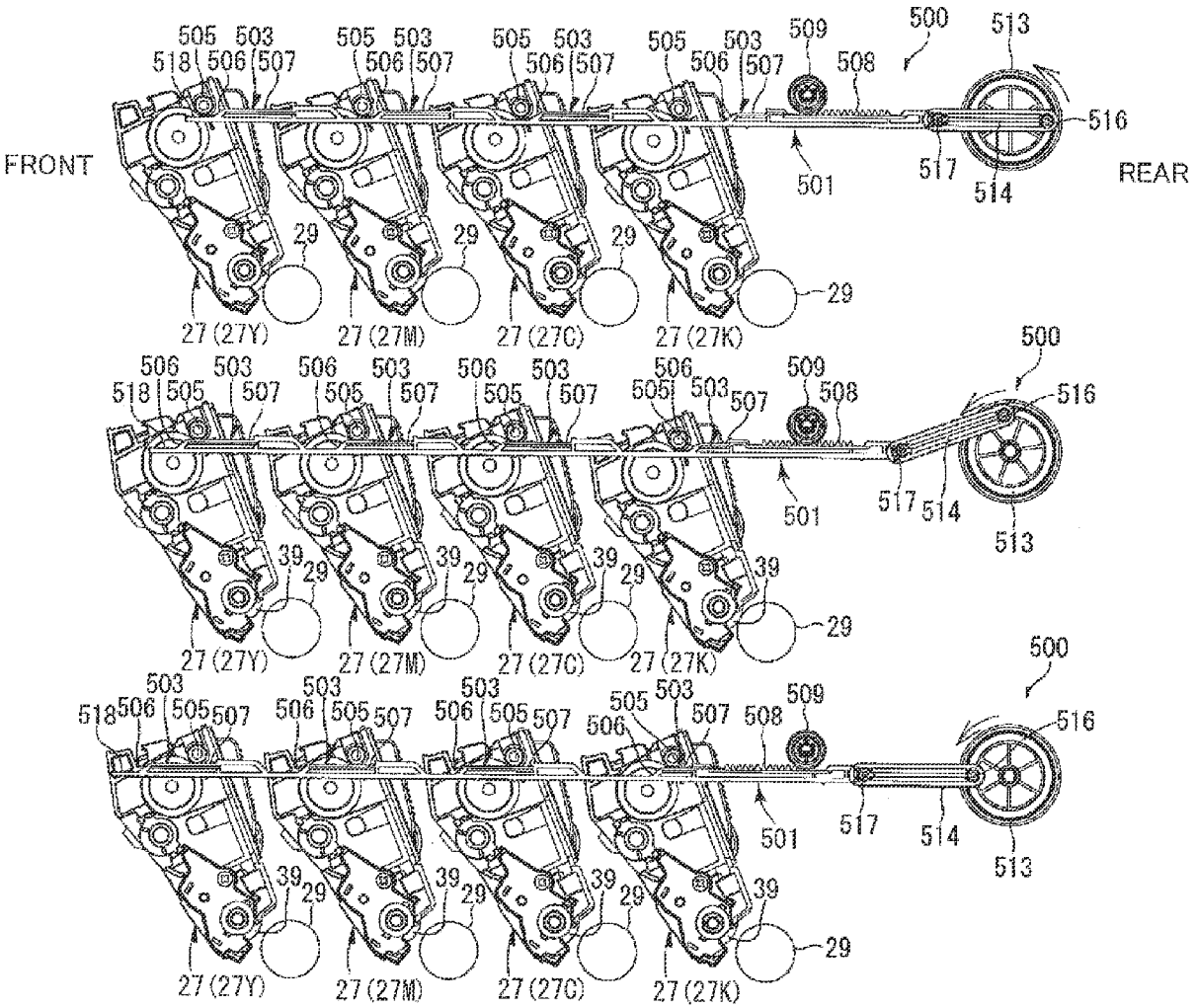
FIG. 30(*a*) is a right side view showing the developing cartridges at contact positions.

Each of the contact/separation members 501 is movable between a rearmost position shown in FIG. 30(*a*) and a foremost position shown in FIG. 30(*c*) in the front-to-rear direction.

Here, in the following description, the four cam parts 503 will be also referred to as a first cam part 503, a second cam part 503, a third cam part 503, and a fourth cam part 503 in the order from the front to the rear. The first cam part 503, the second cam part 503, and the third cam part 503 have the same shape and are disposed at fixed intervals. The distance between the fourth cam part 503 and the third cam part 503 is larger than the distance between the first cam part 503 and the second cam part 503 or the distance between the second cam part 503 and the third cam part 503. The fourth cam part 503 has the separating surface 507 shorter in the front-to-rear direction than the separating surfaces 507 of the first to third cam parts 503.

The synchronous moving mechanism 502 is for transmitting a driving force from the left contact/separation member 501 to the right contact/separation member 501 so as to linearly move the right contact/separation member 501 in association with the linear movement of the left contact/separation member 501.

As shown in FIGS. 28 and 29, the synchronous moving mechanism 502 includes a left rack gear 508 formed on an upper surface of a rear end of the left contact/separation member 501, a left pinion gear 509 engaging with the left rack gear 508, a right rack gear 510 formed on an upper surface of a rear end of the right contact/separation member 501, a right pinion gear 511 engaging the right rack gear 510, a coupling shaft 512 to which the left pinion gear 509 and the right pinion gear 511 are attached so as not to be relatively rotatable, a transmitting gear 550 fixed to the left side plate 399 for transmitting a driving force of a motor (not shown), a crank gear 513 which is rotatable in one direction (counterclockwise direction in FIG. 30) by a rotational force of the transmitting gear 550, a converting member 514 for converting rotation of the crank gear 513 into linear movement of the left contact/separation member 501, and a motor M disposed on an outer surface (right surface) of the left side plate 399 for generating a driving force.

When the contact/separation members 501 are at the rearmost positions as shown in FIG. 30(*a*), the left pinion gear 509 and the right pinion gear 511 engage with front ends of the left rack gear 508 and the right rack gear 510, respectively. When the contact/separation members 501 are at the foremost positions as shown in FIG. 30(*c*), the left pinion gear 509 and the right pinion gear 511 engage with rear ends of the left rack gear 508 and the right rack gear 510, respectively.

As shown in FIG. 29, the coupling shaft 512 is stretched between and rotatably supported by the contact/separation member holders 504.

The crank gear 513 has a center shaft extending in the width direction and is rotatably supported on the left side plate 399. A gear 515 engaging with the transmitting gear 550 is provided on the periphery of the crank gear 513. A rear protruding shaft 516 protruding inward in the width direction is also formed to the crank gear 513.

A front protruding shaft 517 protruding inward in the width direction parallel to the rear protruding shaft 516 is formed at a rear end of the left contact/separation member 501. In the state where the contact/separation members 501 are located at the rearmost positions shown in FIG. 30(*a*) or the foremost positions shown in FIG. 30(*c*), the front protruding shaft 517 is in opposition to the rear protruding shaft 516 in the front-to-rear direction while extending parallel to the rear protruding shaft 516.

The converting member 514 is connected to and extends between the rear protruding shaft 516 and the front protruding shaft 517 such that the rear protruding shaft 516 and the front protruding shaft 517 are rotatable with respect to the converting member 514.

In the state where the contact/separation members 501 are located at the rearmost positions shown in FIG. 30(*a*), the protruding parts 505 of all developing cartridges 27 are located to the front of the corresponding cam parts 503 and oppose the corresponding contact surfaces 518 as shown in FIG. 31. Also, all developing cartridges 27 are held at the contact positions, and the developing rollers 39 of the developing cartridges 27 are pressed against the corresponding photosensitive drums 29.

When the transmitting gear 550 (FIG. 29) is rotated from this state by a driving force from the motor M, the crank gear 513 rotates in counterclockwise direction in FIG. 30(*a*), and the rear protruding shaft 516 moves forward. In association with this, the left contact/separation member 501 moves forward. Consequently, the left pinion gear 509 rotates in clockwise direction in FIG. 30(*a*), and this rotation is transmitted to the right pinion gear 511 through the coupling shaft 512 (FIG. 28). Thus, the right pinion gear 511 rotates in the same direction as the left pinion gear 509, so that the right contact/separation member 501 moves forward. As shown in FIG. 30(*b*), when the crank gear 513 is rotated by about 90 degrees, the protruding parts 505 of the yellow developing cartridge 27Y, the magenta developing cartridge 27M, and the cyan developing cartridge 27C slide on the sliding surfaces 506 of the corresponding cam parts 503, and then run onto the separating surfaces 507 of the cam parts 503. Only the protruding part 505 of the black developing cartridge 27K is located in front of the corresponding cam part 503. As a result, the yellow developing cartridge 27Y, the magenta developing cartridge 27M, and the cyan developing cartridge 27C are raised upward to linearly move to the separating positions. Accordingly, the developing rollers 39 provided in the developing cartridges 27Y 27M, 27C are separated from the corresponding photosensitive drums 29, and only the developing roller 39 provided in the black developing cartridge 27K remains in contact with the photosensitive drum 29.

When the motor is driven further and the crank gear 513 has been rotated by about 180 degrees in the counterclockwise direction as shown in FIG. 30(*c*), the contact/separation members 501 are moved to the foremost positions. Thus, the protruding parts 505 of the black developing cartridge 27K slide on the sliding surfaces 506 of the corresponding cam parts 503, and then run onto the separating surfaces 507 of the corresponding cam parts 503. As a result, the black developing cartridges 27K is raised upward and linearly moved to the separating position, and the developing roller 39 provided in the black developing cartridge 27K also is separated from the corresponding photosensitive drum 29.

After that, when the motor drives further and the crank gear 513 is rotated in counterclockwise direction in FIG. 30(*c*), the rear protruding shaft 516 moves rearward. In association with this, the contact/separation members 501 move rearward simultaneously with each other. When the crank gear 513 has been rotated by about 180 degrees from the state shown in FIG. 30(*c*), all developing cartridges 27 return to the contact positions as shown in FIG. 30(*a*).

In this configuration, all developing cartridges 27 can be located at the separating positions when the printing operations are not performed, and only the black developing cartridge 27K can be located at the contact position when monochromatic printing is performed. Also, all developing cartridges 27 can be located at the contact positions when color printing is performed.

As shown in FIG. 31, when the developing cartridge 27 is raised upward by the cam parts 503, the protruding parts 505 sliding on the sliding surfaces 506 of the cam parts 503 receive a forward force from the sliding surfaces 506. The force received by the protruding parts 505 from the sliding surfaces 506 is divided into a force component in the direction parallel to the sliding surfaces 506 and a force component in the direction perpendicular to the sliding surfaces 506. In the laser printer 1, the inclination direction of the sliding surfaces 506 is parallel to the direction in which the projecting members 119 of the developing cartridges 27 come into contact with the supporting members 88 or 96. Thus, the force component in the direction parallel to the sliding surfaces 506 becomes a force in the direction in which the projecting members 119 are pressed against the supporting members 88 or 96. Accordingly, the projecting member 119 is pressed against the supporting member 88, and the developing cartridge 27 can be moved from the contact position to the separating position in a stable manner.

As described above, the developing cartridges 27 are linearly movable between the contact positions where the developing rollers 39 are in contact with the photosensitive drums 29 and the separating positions where the developing rollers 39 are separated from the photosensitive drums 29 by using the pair of contact/separation members 501. For this reason, the number of parts can be reduced without providing levers for moving the developing rollers 39 to contact with or separate from the photosensitive drums 29 to the developing cartridges 27. Furthermore, the developing cartridges 27 linearly move between the contact positions and the separating positions, and the developing rollers 39 are brought into contact with or separated from the photosensitive drums 29 by this movement. Thus, the distance of separation between the photosensitive drum 29 and the developing roller 39 is determined only based on the distance between the contact position and the separating position. Therefore, variations in the distance of separation between the photosensitive drums 29 and the developing rollers 39 can be reduced.

When the protruding parts 505 of the developing cartridge 27 come into contact with the contact surfaces 518 of the contact/separation members 501, the developing cartridge 27 is moved to the contact position. On the other hand, when the protruding parts 505 come into contact with the separating surfaces 507, the developing cartridge 27 is moved to the separating position. Thus, the distance of separation between the photosensitive drum 29 and the developing roller 39 is determined based on the difference between the height of the contact surfaces 518 and the height of the separating surfaces 507. Therefore, by making the distances of separation between the photosensitive drums 29 and the corresponding developing rollers 39 substantially constant by forming the contact surfaces 518 and the separating surfaces 507 with high accuracy, the developing rollers 39 can be reliably brought into contact with or separated from the corresponding photosensitive drums 29.

Furthermore, the developing cartridge 27 is pressed by the pressing members 121 at positions differing from positions (the protruding parts 505) contacted by the contact/separation members 501, local force can be prevented from being applied to the developing cartridge 27.

Since the linear movement direction of the contact/separation members 501 is the same as the attachment/detachment direction of the drum unit 26, the operation for linearly moving the contact/separation members 501 and the operation for attaching/detaching the drum unit 26 can be carried out from the same direction through the access opening 8 formed on the front surface of the main casing 2.

Since the drum unit 26 can be mounted to or removed from the main casing 2 while supporting the four photosensitive drums 29 aligned in a line, maintenance operations, such as resolution of paper jam or replacement of components, can be simplified.

Furthermore, since each developing cartridge 27 can be individually attached to or detached from the drum unit 26, the developing cartridge 27 can be separately replaced. Thus, maintenance costs can be reduced.

While the invention has been described in detail with reference to the above aspects thereof, it would be apparent to those skilled in the art that various changes and modifications may be made therein without departing from the spirit of the invention.

For example, the pressing members 121 may press the protruding parts 505 protruding from the side walls 107 of the developing frame 36 of the developing cartridge 27, rather than the upper ends of the side walls 107. In this case, the pressing positions by the pressing members 121 are in the vicinity of the side walls 107, so that relatively rigid areas of the developing cartridge 27 are pressed by the pressing members 121, and thus the developing cartridges 27 can be stably pressed by the pressing members 121.

The invention claimed is:

1. An image-forming device comprising:

a plurality of image carrying members provided for respective colors and aligned in a first direction in a main casing;

a plurality of developing units provided in one-to-one correspondence with the plurality of image carrying members, each of the plurality of developing units including a developer carrying member that supplies developer to the corresponding image carrying members;

first and second contact/separation members linearly movable in the first direction, in a second direction perpendicular to the first direction, the first contact/separation member and the second contact/separation member being disposed one on either side of the plurality of developing units in opposition with each other, the first contact/separation member being disposed on one side of each developing unit, and the second contact/separation member being disposed on the other side of each developing unit, and a synchronous moving mechanism that linearly moves the first and second contact/separation members in synchronization with each other, wherein each of the first and second contact/separation members includes a plurality of cam parts in one-to-one correspondence with the plurality of developing units, the plurality of cam parts being formed integrally with a corresponding one of the first and second contact/separation members, the first and second contact/separation members linearly move in the first direction to move at least one of the plurality of developing units between a contact position where the developer carrying member contacts the corresponding image carrying member and a separating position where the developer carrying member separates from the corresponding image carrying member, the developing unit is on the corresponding cam part at the separating position and the developing unit is out of the corresponding cam part at the contact position, the plurality of cam parts is configured to be arranged at intervals in the first direction so that one of the plurality of developing units remains at the contact position and the remaining developing units are moved to the separating positions in a case that the first and second contact/separation members linearly move by a predetermined distance, a first interval of one pair of two adjacent cam parts is longer than a second interval of the remaining pair of two adjacent cam parts, and the plurality of developing units includes respective protruding parts, and each of the first and second contact/separation members has a plurality of contact surfaces and a plurality of separating surfaces paired with the corresponding cam parts, wherein the protruding parts of the developing units at the contact positions contact the corresponding contact surfaces, and the protruding parts of the developing units at the separating positions contact the corresponding separating surfaces.

2. The image-forming device according to claim 1, wherein the plurality of developing units is moved to the separating position in a case that the first and second contact/separation members linearly move by a distance which is longer than the predetermined distance.

3. The image-forming device according to claim 1, wherein in association with a linear movement of the first contact/separation member, the synchronous moving mechanism transmits a driving force from the first contact/separation member to the second contact/separation member for linearly moving the second contact/separation member.

4. The image-forming device according to claim 1, further comprising a motor that generates a rotational force, a crank gear that is driven to rotate in one direction by the rotational force of the motor, and a converting member that converts rotation of the crank gear into linear movement of the first contact/separation member.

5. The image-forming device according to claim 1, further comprising a tandem-type process unit that is detachably attached to the main casing and holds the plurality of image carrying members.

6. The image-forming device according to claim 5, wherein the plurality of developing units is detachably mounted to the tandem-type process unit.

7. The image-forming device according to claim 5, wherein the tandem-type process unit is detachable from the main casing by being pulled in the first direction.

8. The image-forming device according to claim 1, wherein the plurality of cam parts is formed such that: all of the developing units are located at the contact positions when the contact/separation members are at first positions; only one of the developing units is located at the contact position when the contact/separation members are at second positions; and all of the developing units are located at the separating positions when the contact/separation members are located at third positions.

9. The image-forming device according to claim 1, further comprising a plurality of pressing members in one-to-one correspondence with the plurality of developing units, the pressing members pressing the corresponding developing units in a direction in which the developer carrying members press the corresponding image carrying members.

10. The image-forming device according to claim 9, wherein the pressing members contact the corresponding developing units at positions differing from positions of the protruding parts with respect to the second direction.

11. The image-forming device according to claim 10, wherein the positions of the developing units contacted by the pressing members are inward of the protruding parts with respect to the second direction.

12. The image-forming device according to claim 1, further comprising a plurality of supporting members that support the developing units, wherein: the protruding parts slide on the corresponding sliding surfaces when the developing units are moved between the contact positions and the separating positions; and a force applied to the protruding parts from the sliding surfaces when the developing units are moved from the contact positions to the separating positions contains a force component in a direction in which the developing units press the corresponding supporting members.

13. The image-forming device according to claim 1, further comprising a conveying belt facing the plurality of image carrying members.

14. The image-forming device according to claim 13, wherein the conveying belt conveys a recording medium.

15. An image-forming device comprising:

a plurality of image carrying members provided for respective colors and aligned in a first direction in a main casing;

a plurality of developing units provided in one-to-one correspondence with the plurality of image carrying members, each of the plurality of developing units including a developer carrying member that supplies developer to the corresponding image carrying members;

first and second contact/separation members linearly movable in the first direction, in a second direction perpendicular to the first direction, the first contact/separation member and the second contact/separation member being disposed one on either side of the plurality of developing units in opposition with each other, the first contact/separation member being disposed on one side of each developing unit, and the second contact/separation member being disposed on the other side of each developing unit, and a synchronous moving mechanism that linearly moves the first and second contact/separation members in synchronization with each other, wherein each of the first and second contact/separation members includes a plurality of cam parts in one-to-one correspondence with the plurality of developing units, the plurality of cam parts being formed integrally with a corresponding one of the first and second contact/separation members, the first and second contact/separation members linearly move in the first direction to move at least one of the plurality of developing units between a contact position where the developer carrying member contacts the corresponding image carrying member and a separating position where the developer carrying member separates from the corresponding image carrying member, the developing unit is on the corresponding cam part at the separating position and the developing unit is out of the corresponding cam part at the contact position, the plurality of cam parts is configured to be arranged at intervals in the first direction so that one of the plurality of developing units remains at the contact position and the remaining developing units are moved to the separating positions in a case that the first and second contact/separation members linearly move by a predetermined distance, a first interval of one pair of two adjacent cam parts is longer than a second interval of the remaining pair of two adjacent cam parts, and the synchronous moving mechanism includes a first rack gear formed on the first contact/separation member, a first pinion gear engaging with the first rack gear, a second rack gear formed on the second contact/separation member, a second pinion gear engaging with the second rack gear, and a coupling shaft coupling the first pinion gear to the second pinion gear.

* * * * *